US010580542B2

(12) United States Patent
Brunsell et al.

(10) Patent No.: US 10,580,542 B2
(45) Date of Patent: Mar. 3, 2020

(54) CONCENTRATE TREATMENT SYSTEM

(71) Applicant: AVANTech, Inc., Columbia, SC (US)

(72) Inventors: Dennis A. Brunsell, Knoxville, TN (US); Charles E. Jensen, Knoxville, TN (US); Larry E. Beets, Knoxville, TN (US)

(73) Assignee: AVANTech, Inc., Columbia, SC (US)

( * ) Notice: Subject to any disclaimer, the term of this patent is extended or adjusted under 35 U.S.C. 154(b) by 1358 days.

(21) Appl. No.: 14/274,717

(22) Filed: May 10, 2014

(65) Prior Publication Data

US 2015/0221404 A1 Aug. 6, 2015

Related U.S. Application Data

(63) Continuation-in-part of application No. 13/900,548, filed on May 23, 2013, now Pat. No. 9,283,418.

(51) Int. Cl.
*G21F 9/08* (2006.01)
*G21F 9/12* (2006.01)
(Continued)

(52) U.S. Cl.
CPC ..... *G21F 9/08* (2013.01); *G21F 9/12* (2013.01); *A62D 3/00* (2013.01); *G21F 9/30* (2013.01)

(58) Field of Classification Search
CPC ... G21F 9/08; G21F 9/12; G21F 9/125; G21F 9/28; G21F 9/30
See application file for complete search history.

(56) References Cited

U.S. PATENT DOCUMENTS 3,595,393 A 7/1971 Messa et al.
3,666,097 A 5/1972 Ryan
(Continued)

FOREIGN PATENT DOCUMENTS

CN 1232247 C 10/1999
CN 1360315 A 7/2002
(Continued)

OTHER PUBLICATIONS

First Chinese Office Action dated Nov. 3, 2014 in corresponding Chinese patent application No. 201180041888.8, all enclosed pages cited.
(Continued)

*Primary Examiner* — Richard C Gurtowski
(74) *Attorney, Agent, or Firm* — Nelson Mullins Riley & Scarborough LLP

(57) ABSTRACT

One aspect of the invention provides a system for treating wastestream, particularly a liquid or aqueous radwaste, for safe disposal and, in final processing, converting it into one or both forms including an aqueous form for safe discharge to the environment and a solidified form for safe disposal. Another aspect provides the capacity to employ a step where a specific target element strategy can be set up synchronizing sorbent substance choices and multiple recycle options to remove target substances from wastestream as a part of its Sorption or Powder Sorbent Isotopic Reduction step (II). Other steps cooperate with Sorption step (II) including Oxidation (I) to inactivate or destroy existing chelants, Solid-Liquid separation (III), and Selective Ion Exchange (IV) to deliver the wastestream to final processing. Still further aspects of the invention address the recovery and safe handling of substances such as C-14 ($^{14}C$); and also address treating wastestream and removing $^{14}C$ and water of hydration and forming dry solids for disposal, recycle or
(Continued)

other use, such as, for example, granular, pellet or powder waste formation or product; and related special drying means for bringing this about.

25 Claims, 7 Drawing Sheets

(51) Int. Cl.
*G21F 9/30* (2006.01)
*A62D 3/00* (2006.01)

(56) References Cited

U.S. PATENT DOCUMENTS

| | | | |
|---|---|---|---|
| 3,785,780 | A | 1/1974 | Teichmann et al. |
| 3,805,959 | A | 4/1974 | Mertens |
| 3,873,362 | A | 3/1975 | Mihram et al. |
| 3,947,354 | A | 3/1976 | Swanson et al. |
| 3,968,035 | A | 7/1976 | Howe |
| 4,162,230 | A | 7/1979 | Horwitz et al. |
| 4,289,594 | A | 9/1981 | Alpaugh et al. |
| 4,332,687 | A | 6/1982 | Daignault et al. |
| 4,419,246 | A | 12/1983 | Jayawant |
| 4,512,921 | A | 4/1985 | Anstine et al. |
| 4,578,195 | A | 3/1986 | Moore et al. |
| 4,632,847 | A | 12/1986 | Lomasney et al. |
| 4,737,315 | A | 4/1988 | Suzuki et al. |
| 4,770,783 | A | 9/1988 | Gustavsson et al. |
| 4,792,407 | A | 12/1988 | Zeff et al. |
| 4,802,993 | A | 2/1989 | Katoh |
| 4,814,091 | A | 3/1989 | Napier et al. |
| 4,846,978 | A | 7/1989 | Leggett et al. |
| 5,057,220 | A | 10/1991 | Harada et al. |
| 5,080,799 | A | 1/1992 | Yan |
| 5,122,268 | A | 6/1992 | Burack et al. |
| 5,178,772 | A | 1/1993 | Daley et al. |
| 5,196,124 | A | 3/1993 | Connor et al. |
| 5,246,597 | A | 9/1993 | Jenson et al. |
| 5,322,644 | A | 1/1994 | Dunn et al. |
| 5,328,599 | A | 7/1994 | Siefert et al. |
| 5,389,262 | A | 2/1995 | Guess |
| 5,462,671 | A | 10/1995 | Arrington et al. |
| 5,492,633 | A | 2/1996 | Moniwa et al. |
| 5,564,105 | A | 10/1996 | Alvino et al. |
| 5,632,900 | A | 5/1997 | Jevec et al. |
| 5,728,302 | A | 3/1998 | Connor et al. |
| 5,843,308 | A | 12/1998 | Suozzo et al. |
| 5,848,363 | A | 12/1998 | Guillermier et al. |
| 5,885,203 | A | 3/1999 | Pelletier |
| 5,894,077 | A | 4/1999 | Jones et al. |
| 5,908,559 | A | 6/1999 | Kreisler |
| 6,254,782 | B1 | 7/2001 | Kreisler |
| 6,350,376 | B1 | 2/2002 | Imaoka et al. |
| 6,405,626 | B1 | 6/2002 | Bureaux et al. |
| 6,521,131 | B1 | 2/2003 | Hamilton et al. |
| 6,521,809 | B1 | 2/2003 | Smith et al. |
| 6,843,618 | B2 | 1/2005 | Lundy |
| 7,163,632 | B1 | 1/2007 | Speece |
| 7,276,160 | B2 | 10/2007 | Jangbarwala |
| 7,282,470 | B2 | 10/2007 | Tucker et al. |
| 7,772,451 | B2 | 8/2010 | Enda et al. |
| 8,753,518 | B2 | 6/2014 | Brunsell et al. |
| 9,283,418 | B2 | 3/2016 | Brunsell et al. |
| 2003/0108462 | A1 | 6/2003 | Oskoui |
| 2006/0217584 | A1 | 9/2006 | Nunez et al. |
| 2007/0036699 | A1 | 2/2007 | Oskoui |
| 2009/0252663 | A1 | 10/2009 | Witheral |
| 2010/0059428 | A1 | 3/2010 | Boren et al. |
| 2010/0258428 | A1 | 10/2010 | Gignac et al. |

FOREIGN PATENT DOCUMENTS

| | | | |
|---|---|---|---|
| CN | 1988051 | A | 6/2007 |
| CN | 103108677 | A | 5/2013 |
| EP | 0428868 | A2 | 5/1991 |
| EP | 0765842 | A1 | 4/1997 |
| EP | 1803689 | A1 | 7/2007 |
| EP | 1837075 | A2 | 9/2007 |
| EP | 2593191 | A1 | 5/2013 |
| GB | 2005655 | A | 4/1979 |
| GB | 2289975 | A | 12/1995 |
| RU | 2105366 | C1 | 2/1998 |
| RU | 2122753 | C1 | 11/1998 |
| RU | 2203512 | C2 | 4/2003 |
| RU | 2225049 | C1 | 2/2004 |
| RU | 2268513 | C1 | 1/2006 |
| RU | 2313148 | C1 | 12/2007 |
| RU | 2342720 | C1 | 12/2008 |
| RU | 2342721 | C1 | 12/2008 |
| RU | 2541357 | C2 | 2/2015 |
| UA | 14319 | U | 5/2006 |
| WO | 1996037442 | A1 | 11/1996 |
| WO | 2002096559 | A1 | 12/2002 |
| WO | 2007123436 | A1 | 11/2007 |
| WO | 2007127587 | A1 | 11/2007 |
| WO | 2008002282 | A1 | 1/2008 |
| WO | 2012050802 | A1 | 4/2012 |

OTHER PUBLICATIONS

Printout from "Taylor & Francis Online" of Abstract of "Ozonation of Hanford Nuclear Defense Waste," published in vol. 1, Issue 2 of Ozone Sciense & Engineering: The Journal of the International Ozone Association, all enclosed pages cited.

"Simplified Removal of Chelated Metals," published Apr. 2004 in vol. 102, Issue No. 4 of "Metal Finishing," all enclosed pages cited (2008).

"Separation of Heavy Metals: Removal from Industrial Wastewaters and Contaminated Soil," all enclosed pages cited (1993).

"The Treatment of Radioactive Ion-Exchange Resins: Low-Temperature Resin Oxidation Process," prepared by EPRI Nondestructive Evaluation Center, all enclosed pages cited (1991).

Non-Final Office Action issued in copending U.S. Appl. No. 13/900,548 dated Mar. 3, 2015, all enclosed pages cited.

Extended European Search Report issued in corresponding application 11832996.0 dated Mar. 23, 2015, all enclosed pages cited.

Helmestine, Anne; "Table of Common Standard Reduction Potentials" from the Handbook of Chemistry and Physics, accessed via About.com; 2008; CRC Press; 89th edition.

CONCENTRATE TREATMENT SYSTEM

CROSS-REFERENCE TO RELATED APPLICATIONS

This application claims the benefit of U.S. application Ser. No. 13/900,548, filed May 23, 2013, presently pending, which claims the benefit of U.S. application Ser. No. 13/820,145, filed Feb. 28, 2013 and presently pending, which is a National Stage Entry of PCT/US11/53185 filed Sep. 25, 2011, which Claims Priority from Provisional Application 61/393,804, filed Oct. 15, 2010; the disclosures of which are incorporated herein by reference in their respective entireties.

BACKGROUND OF THE INVENTION

1. Field of the Invention

The present invention relates to a Method, Process or System for processing and treating a radioactive liquid or aqueous concentrate, such as a nuclear fuel plant stream, or liquid or aqueous concentrate containing radwaste or other forms of environmental waste.

2. Background Information

It has been documented that a number of plants in North America, Asia, and Europe, particularly Eastern Europe, and in other locations around the world, have been dealing with the problem of stored radioactive concentrate fluids (or radioactive agents in solution), or historical concentrates, which have, especially in the last 20-30 years grown to great stored volumes at various plants. Therefore, radionuclide removal from nuclear power plant's liquid radwaste has become an important priority for the European Union and its member states and other countries of the world. These plants have frequently included nuclear power plants where energy obtained by nuclear fission is transformed into electricity.

An example of such a plant is the Kola NPP in the Polyarnye Zori/Murmansk Region, Russian Federation. Accumulated LRW (Liquid Radioactive Waste) at this plant had, at one point, been temporarily stored in stainless steel tanks and was to have been processed in such a way as to allow safe long-term storage, haulage and final disposal of such waste. This plan had not proven to be adequately successful. The Kola NPP (Nuclear Power Plant) had operated a system for the removal of radionuclides from evaporator concentrate decantates and salt crystalline deposits. This process had consisted of an oxidation phase and a filtration phase. In their case oxidation was achieved by ozone ejection into the liquid radwaste. However, this approach did not control temperature and pH in an ideal state to further the ozone process involved, allowing it to go up to 90 degrees F. (or about 32.22 degrees C.) where soluble ozone went to about zero solubility; and, therefore, was subject to poor utilization; where it was not absorbed into water and lost as gas. The pH was not controlled in an optimum range that both prevented boron precipitation and optimized utilization of the ozone. Filtration was applied to separate (non-soluble) radioactive oxidation products from its liquid phase, but only micro-filtration rather than ultra-filtration which allowed particulate activity smaller than micro-filtration range to pass. Cobalt, silver and iron isotopes are often found in about colloidal to about the lower end of the microfiltration range. In the past some of the equipment and method approaches used in this system had been found deficient in terms of meeting the needed performance requirements and with regard to the reliability or in terms of efficiency; and in general significant improvements to this type of process have sorely been needed to address this plant and plant areas like this.

Inventions the subject of patent publication in the past suffer from a number of disadvantages; and, in one or more ways, appear to have only tangential relationship to the present invention.

See, for example: U.S. Pat. No. 4,894,091 to Napier et al. which teaches a process for removing metals from water including the steps of prefiltering solids from the water, adjusting the pH to between about 2 and 3, reducing the amount of dissolved oxygen in the water, increasing the pH to between about 6 and 8, adding water-soluble sulfide to precipitate insoluble sulfide- and hydroxide-forming metals, adding a flocculating agent, separating precipitate-containing floc, and postfiltering the resultant solution; and where the postfiltered solution may optionally be eluted through an ion exchange resin to remove residual metal ions.

U.S. Pat. No. 7,772,451 to Enda et al. discloses what is said to be a system for chemically decontaminating radioactive material, distinguishable from the present invention in providing, in its broadest sense, for "a system for chemically decontaminating radioactive material which forms a passage for liquid to flow through, comprising: a circulation loop connected to the passage for circulating a decontamination liquid, the circulation loop comprising a decontamination agent feeder feeding the decontamination liquid that is reductive and that is an aqueous solution comprising a monocarboxylic acid (namely, "formic acid") and a dicarboxylic acid (namely, "oxalic acid") to the decontamination liquid; a hydrogen peroxide feeder feeding hydrogen peroxide to the decontamination liquid; an ion exchanger for separating and removing metal ions in the decontamination liquid; and an ozonizer for injecting ozone into the decontamination liquid or an oxidizer feeder feeding permanganic acid or permanganate to the decontamination liquid; and wherein the system does not contain a device for reducing trivalent iron atoms into bivalent iron atoms, and wherein any acid present in the system is an organic acid. This system, as well as that of Napier et al. just above, does not employ the present invention's process steps of Oxidation or Ozone Oxidation (I) Sorption or Powder Sorbent Isotopic Reduction (II), Solid-Liquid Separation (III), Adjustable and Configurable Ion exchange (IX) (IV), and Within Step V: Discharge of Water (Va) or Drying of resulting waste stream dissolved solids to Dry Solids (Vb).

U.S. Pat. No. 5,196,124 to Connor et al. appears to involve a method for reducing the radioactive material content of fluids withdrawn from subterranean reservoirs which employs the deposition of sorbent solids within its reservoir matrix surrounding its production well to act as an in-situ filter for dissolved radionuclides present in reservoir pore waters. Though using a form of sorption application, Connor does not facilitate this use in the same manner or staging as that set forth in the present invention. It does not employ the order of steps used or the effect so obtained by Oxidation prior to sorption; or Solid-Liquid Separation, Adjustable and Configurable ion exchange, or discharge of water or drying of waste stream dissolved solids to dry solids, all after the step of sorption. See also U.S. Pat. No. 5,728,302 to Connor; engendering similar distinctions in relation to the present invention.

U.S. Pat. No. 5,908,559 to Kreisler sets forth a METHOD FOR RECOVERING AND SEPARATING METALS FROM WASTE STREAMS. The 25 method involves steps, distinguishable from the present invention, where: pH of a waste stream is adjusted; a metal complexing agent is added; a particle growth enhancer is added; a flocculating agent is added resulting in a solution; the solution effluent is dewatered, preferably using a plate and frame press, resulting in a sludge and a supernatant; and metals are recovered from the sludge upon melting, drying and dewatering a filter cake with melting enhancers so as to permit selective removal of a fused metal-bearing concentrate for casting into ingots to be sold to primary smelters.

U.S. Pat. No. 7,282,470 to Tucker et al., though utilizing a water soluble sorbent additive, namely sorbitol or mannitol; is otherwise dissimilar to the steps of the method of the present invention.

U.S. Application No. 200910252663 of Wetherill, provides for a METHOD AND SYSTEM FOR THE REMOVAL OF AN ELEMENTAL TRACE CONTAMINANT FROM A FLUID STREAM; and includes within its steps passing a fluid stream with an elemental trace contaminant through a flow-through monolith comprising an oxidation catalyst to oxidize the elemental trace contaminant; and contacting the fluid stream comprising the oxidized trace contaminant with a sorbent free of oxidation catalyst to sorb the oxidized trace contaminant. However, it otherwise lacks the functional effect brought about by the other inclusive steps of the present invention.

In the PCT publication, W02007123436 (A1) of ALEXANDROVI et al. as inventors; the disclosure appears to disclose the use of a sorbent and the use of oxidizers such as potassium permanganate. However, this process does not employ the order sequence of the 25 present invention; nor employ Solid-Liquid Separation III, Adjustable and Configurable Ion exchange (IX) IV, or Discharge of Water (Va) or Drying of resulting waste stream dissolved solids to Dry Solids (Vb), as carried out in the present invention.

The Russian patent, RU 2122753 (C1) to Dmitriev, et al. appears to set forth elements within a process which consists in oxidative treatment of waste through ozonation in the presence of oxidation catalyst and/or radionuclide collector; solid-liquid separation and, further downstream, a liquid phase finally purified on selective sorbents. However, the order sequence and qualitative composition of the steps is dissimilar to the present invention; and Dmitriev does not employ Adjustable and Configurable Ion exchange (IX) (IV), and Within Step V: Discharge of Water (Va) or Drying of resulting waste stream dissolved solids to Dry Solids (Vb) in the same manner as the present invention; nor is clear from an absence of descriptive illustration as to the routing and nature of treatment to achieve radionuclide separation.

It will, therefore, be understood by those skilled in these technologies that a substantial and distinguishable process and system with functional and structural advantages are realized in the present invention over the past conventional technology with regard to processing, treating, packaging and chemically affecting radwaste liquid or a concentrate fluid stored or located at or in relation to a nuclear plant. It will also be appreciated that the efficiency, flexibility, adaptability of operation, diverse utility, and distinguishable functional applications of the present invention all serve as important bases for novelty of the invention, in this field of technology.

SUMMARY OF THE INVENTION

The foregoing and other objects of the invention can be achieved with the present invention's method and system. In one aspect, the invention includes a method and associated system for processing and treating a radioactive concentrate, often stored as historical aqueous concentrate, or other radwaste or forms of environmental or hazardous waste which includes the steps, designated as Roman numerals: I, II, III, IV and V as follows:

Oxidation or Ozone Oxidation I, when needed for the destruction of existing chelants Sorption or Powder Sorbent Isotopic Reduction II Solid-Liquid Separation II Adjustable and Configurable Ion exchange (IX) IV, and Within Step V: Discharge of Water (Va) or Drying of resulting Liquid waste stream dissolved solids to Dry Solids (Vb).

Further aspects are directed to processing and elimination of C-14 and the water of hydration from radwaste or hazardous amounts or systems. Yet other objectives and aspects include ozone oxidation of all organics to carbon dioxide for removal of C-14; powdered sorbent removal of cesium antimony, silver, selenium and cobalt to low enough levels to facilitate polishing in selective ion exchange columns; ultrafiltration removal of cobalt, manganese, silver and particulate; and establishing pH adjustment to 4 and optimum levels after oxidation using vacuum for C-14 removal.

Yet further aspects are directed to processing and elimination of C-14 and the water of hydration from wastestreams through utilization of film evaporator (TFE) and mixing dryer equipment in drying.

REFERENCE NUMERALS AND SIGNS

Figure 1:
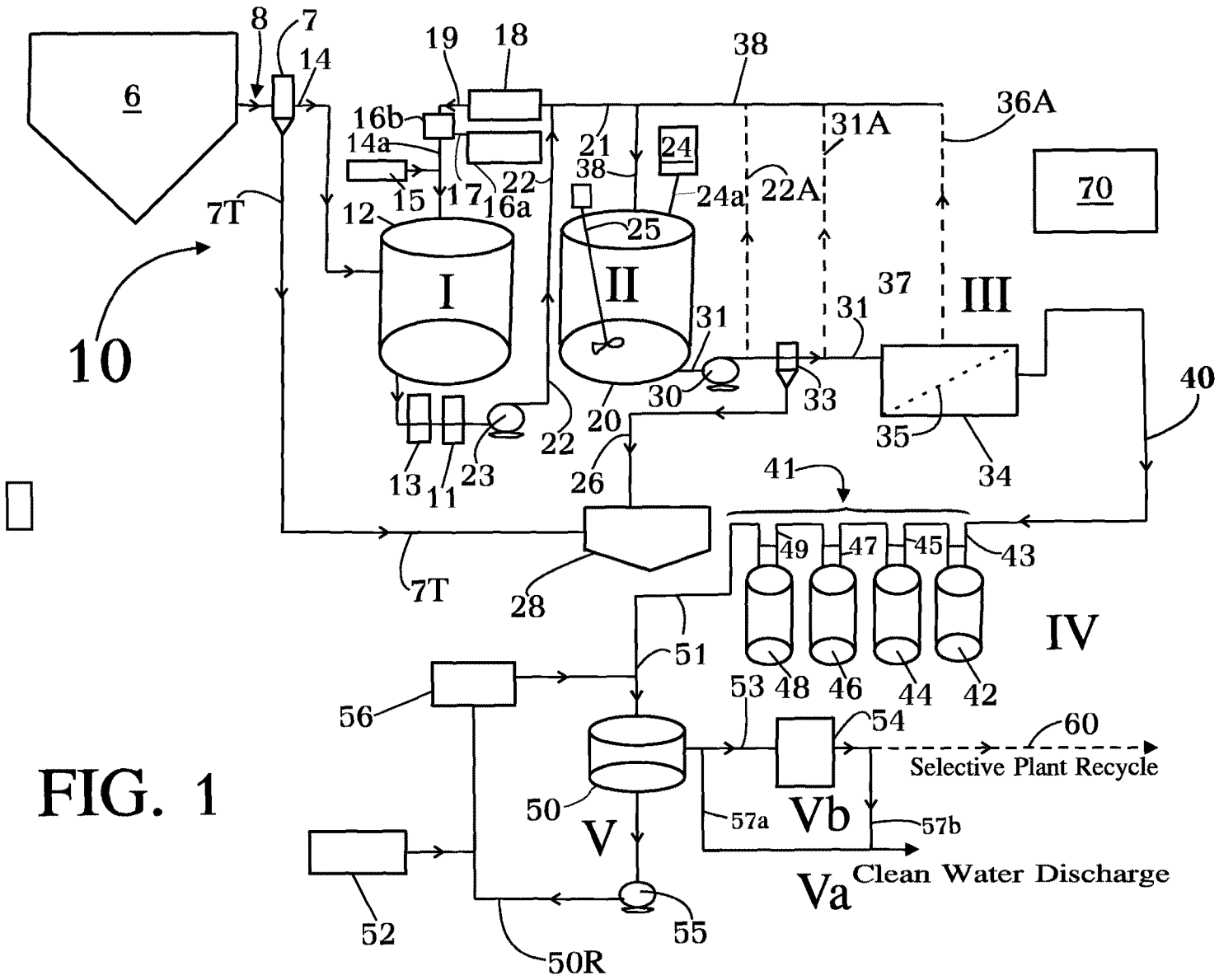
FIG. 1 is a flow chart and schematic representation of an earlier filed co-pending embodiment of the Concentrate Treatment System method of the present invention.

10 method and system of treating radioactive concentrate, the Concentrate Treatment System or invention's method
I (Roman Numeral One) Step of Oxidation or Ozone Oxidation or oxidation step
II Step of Sorption or Powder Sorbent Isotopic Reduction
III Step of Solid-Liquid Separation
IV Step of Adjustable and Configurable Ion Exchange (IX)
V Step of Direct Discharge of Water (Va) or Drying of resulting waste stream to Solids (Vb) and Discharge or Recycle of Water
8 wastestream or feed stream
6 stored location, container area or facility
12 recycle oxidation vessel
14 supply line for (12)
14*a* oxidation return line
IX ion exchange
16*b* ozone eductor and mixing equipment
17 ozone supply line
16*a* ozone supply skid or module
11 ORP measurement station
18 heat exchanger
23 pump (or other equivalent conveyance energy or force)
22 oxidation recycle line

24 sorbent supply area
24*a* supply line from (24)
13 pH/temperature measurement area
15 chemical injection skid
19 eductor supply feed
20 sorbent treatment area (vessel or container)
38 central recycle line
21 transfer line
25 mixer
26 solids transfer line
28 solids collection tank
31 sorbent recycle line
34 filter unit
35 filter media of (34)
33 separation and settling device (and such types of equipment and means)
22A first recycle line
31A second recycle line
36A filter recycle line or third recycle line
30 pump (or other means of motive or conveyance force)
7 solids separation device
7T solids transfer line
28 solids collection tank
40 filter permeate line
42 first IX vessel
43 first IX manifold line
44 second IX vessel
45 second IX manifold line
46 third IX vessel
47 third IX manifold line
48 fourth IX vessel
51 IX effluent line
49 fourth IX manifold line
41 manifold system
50 monitor tank
53 evaporator feed line
54 evaporator unit
52 pH adjustment station
56 pH measurement station
50R recycle line of (50)
55 pump
57*a* line (associated with Step Va)
57*b* line (associated with Step Vb)
60 reuse line (selective recycle line to plant)
70 Process controls (for Remote or Computer System Operation)
PLC Computer utilized within the scope and teachings of the invention, programmed to control all the major functions of the system 10 in the sequence required for safe startup, operation and shutdown of the invention's system
HMI Human Machine Interface (or HMI) which is either a dedicated local screen, or on one or more remote computer screens on computers that may be located in a control room supporting use of the present invention, wherein such computers can also be located anywhere in the plant area supporting use of the present invention, or anywhere in the world when internet lines available
71 Soluble Calcium Salts
72 pH adjustment
73 pH adjustment before oxidation with ozone in step (I)
74 pH adjustment after oxidation with ozone in step (I)
75 Evacuation
76 Providing a temperature range for drying in step Vb from greater than or equal to about 100 deg. C. to a temperature of less than or equal to about 240 deg. C.
15A Second Adjustment Skid for providing each of further Acid and Caustic along or into the oxidation return line (14*a*) or oxidation recycle line (22)
75A Flow through Membrane Degasifier with Vacuum Pump utilized along oxidation return line (14*a*) or oxidation recycle line (22)
54*a* drum dryer unit or means for drum-drying, a part of the evaporation unit (54)
54*b* kiln unit or means of providing kiln heating or evaporation, a part of the evaporation unit (54)
78 means for further separation and storage
78*a* hydrocyclone
78*b* collection tank for sorbent to be recycled to next batch
80 Thin Film Evaporator or (TFE) or thin film evaporator means, or equivalent equipment
82 Mixing Dryer, for example, without limitation, such as a Readco SC, and other such types of equipment, or mixing dryer means or equivalent equipment

DETAILED DESCRIPTION OF THE PREFERRED EMBODIMENTS

The following description of the preferred embodiments of the concepts and teachings of the present invention is made in reference to the accompanying Drawing figure which constitutes an illustrated example of the teachings, and structural and functional elements, of the present invention's method and system; among many other examples existing within the scope and spirit of the present invention.

Referring now to the Drawing illustrations FIGS. 1 through 7 set forth with regard to the present invention and method (also referred to herein as the Drawings), thereof, there is illustrated by schematic means exemplary embodiments of the present invention addressing the method and system of treating radioactive aqueous concentrate, the Concentrate Treatment System or invention's method, process and system 10.

In a preferred embodiment of the invention the following steps are included:

Oxidation or Ozone Oxidation—Step I (Roman Numeral One) Sorption or Powder Sorbent Isotopic Reduction—Step II Solid-Liquid Separation—Step III Selective or Adjustable and Configurable Ion exchange (IX)—Step IV Step V: Discharge of Water (Va) or Drying of resulting dissolved solids stream to Dry Solids V (Vb) and evaporate stream that can be either environmentally discharged or recycled for reuse.

The invention can address a number of problems involving known quality of the water, proposed effluent release limits, and major waste volume reduction during reprocessing of existing stored and new concentrates, as well as a number of other substances, concentrates and fluids.

The invention's method 10 can also act to remove such substances as Antimony, Cesium, Cobalt Chromium, Manganese, Iron, Silver and other contaminants. The oxidation step I (Roman numeral one) of the present invention is preferably a batch operation, though other cycles and volume orientation such as 'continuous' and others can be utilized, lasting from about one (1) hour to about forty-eight (48) hours. The liquid waste stream 8 is provided from a stored location, container area or facility 6.

The concentrates or radioactive concentrates discussed above which have been stored for a period of years (historical waste) or recently produced are subject radwaste substances for which the present invention process can be effectively used. In a preferred embodiment of the invention the stream 8 will consist of an historical concentrate stored over the years or recently produced as discussed above in various containers or facilities. The waste stream 8 is provided or transferred from the stored location 6, containing such radioactive concentrate, often stored, without limitation as to type, as historical concentrate, or other radwaste or forms of environmental or hazardous waste, to the recycle oxidation vessel 12 by the supply line 14.

The waste 8 treated by the method 10 will at least in part frequently already contain chelants such as oxalic and citric acid, EDTA, LOMI solution and others. More likely, though not always, the waste 8, the subject of treatment, will contain Oxalic & citric acid and occasionally EDTA. As indicated more fully below, these chelants or others present will he destroyed or inactivated so as not to form a part within the present method 10 of actually or specifically extracting radioisotopes and target substances from the waste 8. This is principally accomplished in the present invention with oxidation and polishing, as opposed to chelation, as set forth herein.

During a contemporaneous period of time during or after the transfer, the pump 23 is started to recycle concentrate from and returning to vessel 12, and heat exchanger 18, when utilized; and the pH and temperature (pH/temperature) measurement area 13 and ORP measurement station 11 are used for measurement purposes to determine further treatment required. The suitability of pH is determined and adjustment is performed if required using the chemical injection skid 15. If antifoaming agent is required this is added using the chemical injection skid 15. The heat exchanger 18 is utilized if temperature adjustment is required to adjust the temperature to a more favorable oxidation range. Due to the increased solubility of oxygen and ozone at lower temperatures the use of cooling to maintain a lower concentrate temperature will increase the rate of oxidation as more oxidant will be dissolved and thus available for oxidation.

After chemical additions the ozone which is supplied on line 17 from an ozone supply skid or module 16*a* goes through the ozone eductor 16*b* provided or communicated directly by/in ozone supply line 17 with a volume of ozone or other oxidant supplied through chemical injection skid 15. The oxidation process (I) (or ozone supply process) as manifested in the vessel 12 may also involve (be assisted or replaced by) chemicals such as permanganate (or potassium permanganate), hypochlorite (or sodium hypochlorite), perchlorate, and/or hydrogen peroxide (H2O2), and/or other oxidants. The Oxidation step (I) (Roman numeral one) will also involve measuring ORP and pH to monitor the status of the oxidation of the waste stream 8.

In this regard, as shown by example in the Drawing figure, ORP is measured at ORP measurement station 11 on recycle to the oxidation vessel 12. In so doing the water is recycled through ozone eductor 16*b* to oxidize the organics and metals in the wastewater from the vessel 12 and thru chiller 18 to maintain a lower temperature for better solubility of ozone using pump 23 or other equivalent conveyance energy or force. It is a teaching of the present invention that the destruction of chelants, such as, for example, EDTA, citric: acid, oxalic acid and others; is necessary within the invention's process to release activity so that this dissolved activity can be removed in a concentrated solid form, and the aqueous phase can be either environmentally released or recycled. As indicated below the stream 8 is communicated or transferred through supply line 22; which, in so doing, provides for transfer of the stream 8 as an oxidized solution from vessel 12 to sorbent treatment area 20. Separation of treatment to a second vessel provides for both increased system throughput and prevents possible sorbent residues from being oxidized by subsequent oxidation treatments that may result in formation of intermediate chemicals that are both difficult to oxidize and that prevent proper sorbent removal in the sorption step II (Roman numeral two).

The pH of the solution to be treated is an important factor in utilization of the ozone in preferred embodiments of the present invention. In the oxidation step I (Roman numeral one), involving the destruction of chelant the pH should preferably be below about 12.5 and more preferably less than (<) about 12 for oxidation of chelants. Higher pH values provide poor utilization of the ozone in oxidation of chelants. Starting pH may be higher if other organics are present and when oxidized reduce the pH to the preferred value prior to the oxidation of the chelants. Otherwise an acid compatible with the system should be added to adjust the pH to this value prior to the start of oxidation of the chelants, if present.

The pH has a large effect on the required ORP to meet the required final oxidation. During the period of initial oxidation of the typical chelants in the concentrate the pH does not change appreciably as chelant structure is broken into smaller chemical components that are not chelating in nature. When the organic from the chelant has been destroyed the pH again begins to lower indicating the production of CO2. At this time the oxidation is often sufficiently complete to permit precipitation of cobalt and other metals and release of other isotopes for removal either by sorbents or selective ion exchange.

With regard to pH controls and Oxidation step I in the present invention, pH control is essential for solubility of some constituents and provides for optimum oxidation. The solubility of some constituents is very sensitive to pH; therefore, either a minimum or maximum pH may be maintained to prevent precipitation of a salt that is not required to be precipitated prior to final discharge or drying. The oxidation process also has an optimum pH target to minimize usage of the oxidant and maximize the rate of oxidation of a given chemical specie. In the method 10 of the invention pH may be adjusted at various points in the oxidation to minimize time without getting outside the solubility range. The oxidation of the chelants is often very slow at a pH outside the optimum range. The pH adjustment may be delayed until low molecular organics and more easily oxidized organics are oxidized so as to shift the pH range into more optimum ranges without chemical addition. Therefore, pH monitoring versus ORP levels during oxidation is essential to know when to add pH adjustment chemicals. A continuous extended period with no pH change but increasing oxidation may indicate entry into the chelant oxidation process, especially when ORP changes slow to a relatively steady increase with no constant decrease in pH. This will normally occur in about the +300 to +1000 mV ORP range depending upon pH. Therefore, as shown by example in the Drawing, if the pH 25 at pH/temperature measurement area 13 is greater than a pH of 12 then the pH should be lowered through the addition of suitable acids at chemical injection skid 15.

Also, in the present invention pH is an indicator when the oxidation of chelants into smaller components is nearing completion, and as oxidation of the smaller components to CO2 begins to lower the pH which has been nearly constant during breaking of the 5 chelants. The breaking of chelants into smaller pieces which no longer can chelate the metals occurs preferentially to oxidation of most of the pieces. This chelant oxidation process is indicated by little or no change in pH. Once a change of about 0.01 to about 0.1 pH unit has occurred greater than (>) about 99.9% of the chelant has already occurred and the radioisotopes can be removed by filtration, sorbents (Step II) and Adjustable and Configurable ion exchange (Step IV).

In a related aspect of the invention the oxidation return line 14*a* supplies a recycle volume which comes through the heat exchanger 18 to lower the temperature of the recycle volume to a preferred temperature of below about 80 degrees F. (or about 26.67 degrees C.), but preferably closer to about 60 degrees F. (or about 15.56 degrees C.) when possible, before entering the supply line 14 directly or through eductor supply feed 19 and continuing back to the vessel 12 as illustrated schematically in the Drawing. In this manner ozone can be more ideally utilized in lines before and in vessel 12.

The waste stream 8 is pumped, for example by pump 23, or otherwise communicated in oxidation recycle line 22, in a batch sequence, to the recycle sorbent area, vessel or container 20. As shown in the Drawing, line 22 leads to transfer line 21. Transfer line 21, therefore, constitutes a short connector line between oxidation recycle line 22 and central recycle line 38, such that line 38 communicates recycle all the way to the recycle sorbent area or vessel 20. In the sorbent area 20 sorbent substances are added from the sorbent supply area 24 through the supply line 24*a*, or other means of transfer or communication, and mixed well using mixer 25, or equivalent stirring or mixing means, with the waste stream 8 in the area 20. A number of sorbent substances or materials, and particularly those powdered sorbents preferred for use in the present invention, are available and known in the art which can be utilized in step II. The sorbent could also include ion exchange media especially in a finer mesh size that may not be practical for column polishing. Generally speaking, a sorbent is defined as a substance that has the property of collecting molecules of another subject substance (which, itself, may be mixed with yet further substances not sought for collection) by sorption or by taking up and holding the subject substance by either adsorption or absorption. Sorbents in the present invention are utilized to remove a large percentage of the radioisotopes or other undesirable contaminants rather than using selective ion exchange materials as these sorbents are at least about 10 to 100 times more volume efficient than selective IX materials so that waste volumes for disposal are significantly reduced, thus lowering operating costs. Sorbent substances are chosen and mixed in the container 20 such that the stream 8 is placed in a chemical orientation for ionic removal and such that ionic bonding is formed for longer hold-up in this area when needed. The powdered, granular, liquid ionic flocculent and other forms of sorbents are such that they constitute ion exchange material acting as an absorbent and forming ionic bonds and early-stage particulate. Additionally, in preferred embodiments, precipitate and chemically sorbent solids which are formed in the recycle sorbent vessel 20 are transferred or communicated on/in the solids transfer line 26 to the solids collection tank 28. This process may be repeated sequentially with additional sorbents when needed; i.e., one or more sorbents may be added to the sorbent container 20 in a manner selected to address sorbency-targeting of one or more selected element substances. Such adding of individual sorbents, when chosen, creates a sequential adding of sorbents and sorbent addition strategy to best target element substances in the sorbent container 20 during related or contemporaneous time periods while such element substances are present in the sorbent container 20 and being processed.

The waste stream 8, as treated in the container or area 20, is then pumped or otherwise communicated on the supply line 31 to the subsystem carrying out solid-liquid separation step III, as illustrated schematically in the Drawing. Solids are typically separated using a combination of centrifugal separation and settling (33) and filtration (34). Hydrocyclones, and such like means, are a preferred method for initial separation of sorbents followed by ultrafiltration to remove very fine or colloidal solids. Centrifugal separation is particularly effective at concentrating the solids for disposal. However, it will be understood that other similar means may be used to carry out the same functional purpose.

The filter unit 34, to which the stream 8 is provided by supply line 31; is illustrated representationally as showing an ultrafiltration setup having at least one media or membrane sub-unit. In a preferred embodiment of the invention one or more Tubular Ultrafilter Membranes are utilized although the ultrafiltration employed does not have to be tubular in nature and one or more of such units can be employed. An example of a preferred ultrafiltration unit is the TUF™ System from Diversified Technologies Systems, Inc., in Knoxville, Tenn. The TUF™ System; i.e., the "Tubular UltraFiltration" System, filters the waste stream 8 to less than about 0.05 micron, and is capable of removing virtually 100% of suspended solids, metal complexes, and most colloidal material from the stream by passing it through a series of cross-flow membranes. As indicated, other types of cross-flow membranes and media can be utilized. Additionally, in a preferred embodiment, the separation and settling device 33, and these types of centrifugal equipment and devices such as a hydrocyclone, can be used in the present method 10 to remove sorbent materials in advance of the filter unit 34 (or ultrafiltration units), to get such solids back out once they had been introduced in the sorption step II.

As illustrated in the Drawing regarding respective recycle lines in preferred embodiments thereof: first recycle line 22A, second recycle line 31A and third recycle line 36A; are provided as a part of the invention's method 10 in preferred embodiments.

Thus, in a preferred embodiment of the invention's method 10 the sorbent treatment area (vessel or container) 20 has three possible recycle paths: first, second and third recycles; depending upon the operation required in the system. The first recycle line 22A before the separation and settling device 33 allows mixing of the sorbent without removal of solids thus utilizing sorbent that may settle into line 31 and assist mixing. The second recycle line 31A provides for removal of sorbents or other solids without filtration. This may be utilized when current sorbent should be removed prior to a subsequent sorbent that is to be added. The third recycle line 36A can utilize both the separation and settling device 33 and the filter unit 34 with the reject being returned through recycle line 36A and line 38 to sorbent treatment area 20 for further processing, with pump 30 providing the motive force. Line 38 can comprise several grouped respective lines for use in different directions as needed. Therefore, if there are no solids present there is no need to remove solids prior to sorbent treatment (20) in the concentrate stream 8 and only one sorbent is utilized in the sorbent treatment area or vessel 20, the first and third recycles (respective lines 22A and 36A) being utilized. If solids are to be removed from initial concentrate stream 8 or if at least two (2) separate sorbent treatment cycles are utilized in the sorbent treatment area or vessel 20; i.e., the first sorbent is removed before utilizing the second (or respective additional) sorbent for absorption of targeted element substances; then the second (2nd) recycle (line 31A) is employed additionally. The separation and settling device 33 can be any of a number of centrifugal separators; for example, units such as a hydrocyclone which is preferred in the embodiments just discussed herein, or a centrifuge or other similar or equivalent type of equipment or other equipment accomplishing a separation function.

In the preferred embodiment illustrated in the Drawing, a further separation and settling device 7 (such as a hydrocyclone or equivalent separation means) is utilized on supply line 14 shortly after leaving stored container area 6 in a sub-step to process and remove solids which are then communicated directly to, or on/in solids transfer line 7T, to the solids collection tank 28. Solids may be removed using solids separator 7, preferably a hydrocylone, during this transfer to decrease the consumption of oxidant, decrease the time for oxidation and eliminate the possibility of release of radioactive isotopes from the solids that later must be removed.

In related preferred embodiments of the invention's method 10, and in the case of the third recycle line 36A, portions of the stream 8 on the rejected side of the filter media 35 are recycled back along the recycle line 36A and the central recycle line 38 to the sorbent treatment area or vessel 20 as illustrated by example in the Drawing illustration. Recycle of the stream 8 through the tubular ultrafilter cleans the membranes resulting in extended membrane life and less maintenance.

Portions of the waste stream 8 on the permeate side of the filter media 35 in the filter unit 34, in the Solid-Liquid Separation step III, are communicated directly to the filter permeate line 40. The line 40 communicates such portions of the waste stream 8, exiting the filter unit 34 to ion exchange units (in preferred embodiments of the invention) comprising the method's (10) Adjustable and Configurable Ion Exchange (IX) step IV. The ion exchange (IX) vessel units, which can number one (1) or more, are shown representationally by example connected in series by manifold lines as illustrated in the Drawing in connecting and affording the ion exchange (IX) units selective, adjustable and configurable bypass options in transporting the stream 8 in relation to one another in an exemplar alignment as follows: the first IX vessel 42, the first IX manifold line 43, the second IX vessel 44, the second manifold line 45, the third IX vessel 46, the third manifold line 47, the fourth IX vessel 48 and the fourth manifold line 49. The first IX vessel 42 is supplied with the stream 8 from the filter permeate line 40; and the last (fourth) IX vessel 48, in this case shown by example in the Drawing, is connected to the IX effluent line 51. The manifold lines 43, 45, 47 and 49, functionally manifested as the manifold system 41, is installed and positioned, and functions within the Adjustable and Configurable ion exchange (IX) step IV, such that the manifold lines 43, 45, 47 and 49 extend and connect to the respective IX vessels 42, 44, 46 and 48, as well as communicating with the filter permeate line 40 and the IX effluent line 51; as 10 illustrated by example in the Drawing. Each of the manifold lines; 43, 45, 47 and 49 can also be regarded functionally and structurally in the present invention as an influent/effluent header with bypass connection line. Each of the manifold lines (43, 45, 47 & 49), which can also be described as influent/effluent manifold lines, consists of 15 an H-shaped (i.e., configuration of the alphabetical letter "H" when viewed from at least one axis of sight) piping structure that has valves on piping running into (influent) and out (effluent) of the vessel. These are normally in an open position when the vessel is in service. A valve is also located on the cross piping between the influent and effluent and is called the bypass valve. The bypass valve is normally closed during vessel use. If the vessel is to be bypassed the bypass valve is opened and the influent and effluent valves are closed thus bypassing flow to the vessel, and facilitating the selection and adjustable or configurable alignment of those vessels to be specifically employed during this step when in use in the field.

Thus, collectively, the manifold system 41 permits the ionic exchange (IX) vessels (as shown in this example of the present invention as 42, 44, 46 and 48) to be entered into flow path or removed without changing piping. Thus media in the vessels will not be exposed to wastewater that does not require further removal of a given isotope; or, when completely expended, can be removed from the flow path for media removal in step IV. It will be appreciated that elements of the manifold system 41 can be positioned, structured and/or connected to accommodate any number of vessel units utilized in the Adjustable and Configurable ion exchange (IX) step IV, and that a number of different means and structural orientations and positions can be utilized in carrying out the method's bypass function in relation to the IX vessel units utilized to carry out step IV and the selection choice of those IX vessels (for example 42, 44, 46 and/or 48) to actually be used in step IV when the system (10) is in operation in the field.

It will also be appreciated that a number of IX arrays, sequences and connections can be utilized in the equipment carrying out the ion exchange (IX) step IV. One such arrangement in a preferred embodiment of the invention employs the equipment illustrated in the Drawing. The ion exchange step IV can employ media addressing additional removal to that of Cesium. It can clear water of all Cobalt and other targeted isotopes, such as media to address any Antimony, Cesium and other isotopes. It will be understood that a number of substances in media can be employed including, but not limited to, bead resin, zeolite and others.

The fifth overall step (V) of the present invention's method; involving Discharge of Water Va or Drying of resulting dissolved solids to Dry Solids Vb, as illustrated by example in the Drawing figure; involves communicating the resulting stream 8 from the $4t^{h}$ IX vessel 48, last IX vessel in the selected array of such units (in the exemplar case, the fourth IX vessel 48) or the last of such units utilized or chosen; to the IX effluent line 51 leading, or directly, to the monitor tank 50. The various chemicals remaining in the water (i.e. for example: sodium borate, sodium sulfate, permanganates, nitrates and chlorides) represent the dissolved solids. The water which has had the radioisotopes removed must be analyzed for isotopic content before being released to the environment to assure that discharge limits are met; so the water is held in the monitor tank 50 before either being discharged or sent to the evaporation step Vb.

Clean, environmentally suitable, discharged water therein, and in preferred embodiments so confirmed by analysis, can, therefore, be released and discharged Va to the environment. This process is capable of releasing to the environment essentially about 100% of the dissolved concentrate. An alternative pathway of the discharged stream in the tank 50 can be transferred or communicated by evaporator feed line 53 to the evaporator unit 54 for drying of dissolved solids (Vb), producing non-radioactive industrial disposal solid waste material and dischargeable evaporate condensate and release of the vapor to the atmosphere. In so doing, the overall temperature range in step Vb will be from greater than or equal to about 100 deg. C. to a temperature of less than or equal to about 240 deg. C. In the present invention it is preferred to utilize a center temperature of greater than or equal to about 100 deg. C. for general water removal; and a temperature range of greater than about 100 deg. C. to about 240 deg. C. for water of hydration removal. In the present method 10 an example of preferred equipment utilized to carry out evaporation in the unit 54 is the DrumDryer™, manufactured by Diversified Technologies Services, Inc., Knoxville, Tenn./USA, which minimizes the volume of the dried product by producing a dense hard product with minimal voids. A number of other types of means and equipment can also be used to carry out the evaporation function of the evaporator unit 54. The evaporate is very high quality water produced from the evaporator unit 54 which is devoid of dissolved solids. The evaporate from the evaporator unit 54 is conveyed or sent by line 57*b* to be discharged to the environment as part of Step Va on line 57*a* or optionally or selectively recycled to the plant by reuse line 60 or other means which may occur in some applications.

The pH can also be a valuable tool in optimizing the rate of drying and minimizing the final dried volume. For example, in the presence of boron a pH of greater than about 12 is desirable to maximize solubility of boron prior to precipitation with optimum pH of about 12.5 to about 13. The higher pH maximizes the solubility of the boron thus preventing premature precipitation resulting in poor heat transfer. This maximizes the heat transfer of the liquid from the heating surfaces even though the liquid becomes very viscous. Therefore, when evaporation is finally minimized as the solution approaches solubility at the elevated temperature, simple removal of heat causes the thick solution to crystallize as the temperature lowers. All remaining water is chemically bound in the crystalline structure.

Accordingly, in a preferred embodiment of the invention, the concentrate with a majority of boron prior to drying should be increased to maximize solubility before entry into the evaporator unit 54 to maximize drying efficiency. Caustic is added through pH adjustment station 52 to reach desired pH value at pH measurement station 56 during recycle on transfer line 50R with pump 55. In the case of sulfate systems the pH may need to be adjusted to the acid side to obtain the same effect.

The elevated pH also minimizes nucleate boiling that causes spattering which results in salt buildup in the fill head.

Additionally, preferred embodiments of the present invention's method 10 include process controls 70 for remotely carrying out functional steps and sub-steps of the invention by computer and electronic means.

Therefore, the operation of the invention 10 can normally be conducted remotely and often under automatic computer control to minimize radiological exposure and minimize operator time demands. The potential dose of some of these components can cause dangerous exposure to personnel. Although shielding can minimize exposure long-term exposure is still a concern. Thus, remote operations for most activities can be employed in preferred embodiments by the invention 10. The use of automated valves, remote controlled motors and feeders, sensors with remote displays and connections to process logic controller or PLC are therefore encompassed within the invention's method 10. Also, these controls can activate and control oxidation monitoring and completion, sorbent addition, level, volume and weight, pressure on filtration, and evaporation.

The PLC is a computer programmed to control all the major functions of the system in the sequence required for safe startup, operation and shutdown of the invention's system. This minimizes the operators that must monitor the system and nearly eliminates operator radiological exposure. The PLC is also a better means of optimizing system operation through programmed analogs that would otherwise be more difficult for operators to implement, requiring extensive training. The PLC monitors parameters every few seconds and is able to recognize and correct operational problems, send warning and alarms and safely shutdown the system. Optimization of operations can occur by changing pump speeds, valve positions, and addition of chemicals for pH or foaming problems.

The PLC is interfaced by use of a Human Machine Interface or HMI which utilizes a dedicated local screen or one or more remote computer screens on computers that may be located in a control room. Such computers can also be located anywhere in the plant or world through internet connections. This permits supervisors, management and equipment supplies to remotely monitor the system for proper operation and further optimization.

The HMI is also capable of recording data from the system for permanent record, for trending system parameters and for generating management reports for the invention's system operation. These trends and reports can warn management of upcoming maintenance requirements. Even issues like membrane cleaning can be handled automatically between batch operations.

In another included use of the present invention the removal of C-14, a radioactive isotope of Carbon, thought or known to exist in the subject wastestream (8), in a preferred embodiment of the present invention is accomplished before the attainment of the final dried product by chemical treatment in the sorbent vessel, or the environment of step (II) through the addition of a soluble calcium salt 71, including CaCl2, Ca(NO3)2, and other such salts; probably in liquid form (but not required); that results in the precipitation of calcium carbonate finally being removed with other sorbent solids. Removing C-14 is important as a use of the present invention, and objective thereof, in that a very limited amount of C-14 is permitted to be present in the DrumDryer or drying solids in step Vb of the invention to obtain free release to the environment (under existing environmental regulations). Typical C-14 isotope and Citric Acid (and other chelants and organics) are known to exist in waste waters of nuclear facilities in concentration or levels greater than would be an acceptable by those skilled in the art at least in areas such as Russia (e.g., Russian designed VVER), Slovakia and other countries. C-14 can come from almost any organic present in the primary water that passes through the reactor during the fission reactions. In the present invention the use of Ozone in the present invention destroys all the organics. As it has been determined that citric acid and oxalic acid are chelants that hold Cs, Co, Sb and others in solution it must be destroyed to release the isotopes.

Generally speaking, C-14 requires special analytical techniques to identify its presence, and C-14 is one of a number of other substances that might be a part of the incoming wastestream, which are not easily identified using normal gamma, beta and alpha analysis; but, are understood by those skilled in certain areas of the world to often be a radwaste constituent. However, when the presence of such a substance is suspected or known the present invention can be utilized to remove them. For example, in the U.S. the presence of C-14 may not be inherently understood by one skilled in the art, as the U.S. does not normally use C-14 substances, while countries like Russia and Slovakia, responsive to organizations like the EU, or other countries, might well use these substances in the primary water of a NPP or similar Boron wastestream. The fact that countries such as Russia and Slovakia may have to account for C-14, or other such substances, and the effect that it would have on overall processing, is, thus, considered an additional use to be indicated within the scope of the present invention when this occurs in the NPP original wastestream addressed by the present invention.

The removal of C-14 in the Ozone Recycle Vessel, or as a part of step (I), is an alternate method utilized in the present invention, by first lowering the pH (or applying a pH adjustment) 72 to a range of about 5 to about 7, or about, or approximately, 6 where solubility of CO2 is minimized and carbonic acid is not readily formed. The pH adjustment can be made either before 73 or after 74 oxidation with ozone in step (I) that destroys the organic containing the C-14. Preferable pH adjustment would be before oxidation due to immediate release to the gaseous phase where some C-14 would be swept out with the oxygen and unreacted ozone. The lower pH may also aide the rate and efficiency of ozone oxidation. After the ozonation is complete the vessel would be subjected to evacuation 75 to a preferred vacuum level range of about 18 in. to about 28 in. Hg vacuum, or lower than about 20 in. Hg, or a range of about 20 in. Hg to a range of about 28 in. Hg; if needed, to cause the CO2 to effervesce from the liquid along with oxygen and ozone, thus removing C-14 from the liquid. It has the added benefit of also removing ozone and oxygen from the liquid thus potentially eliminating the step of passing the liquid through a carbon bed to destroy the ozone. A flow through degassifier which operates with vacuum could also be utilized in evacuation 75 instead of directly applying vacuum to the vessel. The degassifier uses a gas permeable membrane and the vacuum is applied on the gaseous side of the membrane. As a part of step 72 (73 and 74), the pH must then returned to an acceptable level after evacuation 75 to reconvert the boric acid to sodium borate so that any dissolved boric acid/sodium borate is not removed in the following process step.

In another preferred embodiment of the present invention, pathways are provided to remove both the C-14 and the water of hydration. An additional, preferred path for C-14 removal is established through increasing the pH after oxidation for removal of C-14 as carbon dioxide. The oxidation with ozone converts the C-14 to carbon dioxide which at a pH of about 11 converts to carbonate. Removal of C-14 is completed by lowering the pH to less than 4 where carbon dioxide is very insoluble and can be removed to very low levels using vacuum means. The vacuum is applied to both oxidation recirculation tank and a membrane degasifier (75A). Laboratory testing indicated that less than detectable C-14 could be obtained using this technique. Once the degassing is complete the pH is adjusted back to approximately 10.7-11 for the sorbent treatment and selective ion exchange to maintain solubility of the boron.

It is also to be encompassed that 10-20% of the boron may have precipitated in the plant concentrate holding tank mainly due to the addition of nitric acid from ion exchange regeneration in the plant. It may also be possible in some cases that additional boron may precipitate during the acidification during the carbon dioxide removal although the increase in temperature from acid addition can minimize this problem. To aid in the re-dissolution of this precipitated boron the solution is then heated to increase the solubility and rate of dissolution. This heating is supplied using steam injection into the OS Recirc. Tank. A small amount of additional water (possibly 10-20%) may also have to be added to provide insurance that the boron will remain in solution until the concentrate reaches the DrumDryer™ holding tanks where the pH is further adjusted higher to maximize solids in the drums. This additional water will be removed during the drum drying stage and will not affect the waste volume. This additional water will require an additional 10-20% of evaporation time but since the DrumDryer can operate unattended 24/7 the additional time can be made by operation over the weekend. The additional capacity of DrumDryer Hold Tank #2 has the capacity for 3-5 days of operation of the Drum Dryers. The lower activity requirements have led to the addition of two additional selective ion exchange columns for the possible addition of two additional media to help remove some of the isotopes such as Se, Ag, As and Mn that were not specifically targeted due to their relative low activities that were of no concern until the total activity levels were lowered.

The water of hydration is partially removed in the Drum Dryer, but because some of the heat of hydration is held in the chemically bound water of the sodium borate the temperature of the drums must be raised to greater than (>) about 200° C. Although the Drum Dryers can reach 250° C. in the time required to transfer sufficient heat to break all these chemical bonds, this time may be too long in certain application. Thus a drum kiln is added to take the temperature to 425° C. In this regard, in using a four drum kiln, within a few of days the sodium borate will release all of the water of hydration that is bound.

The water or wastestream could be provided as boric acid or as sodium borate depending upon the type of plant or facility involved. If the sodium borate is the feed source, the pH must be lowered to 5-7 in order to be at a pH that will release the generated carbon dioxide to the atmosphere as gas rather than convert the carbon dioxide to bicarbonate or carbonate at higher pH. At a lower pH than 5 the carbon dioxide is converted to carbonic acid that increases the solubility of carbon dioxides.

Sodium borate is much more soluble than boric acid. The solubility curve for boron reaches a minimum around a pH of 7. This means that—some boron will likely precipitate out at a pH of 6. To prevent removal of the boron with the precipitating sorbents the pH must be raised back to a pH greater than (>) 11-12 to resolubilize the boron as sodium borate. The addition of sodium or potassium hydroxide quickly dissolves the boric acid as sodium or potassium borate.

Figure 2:
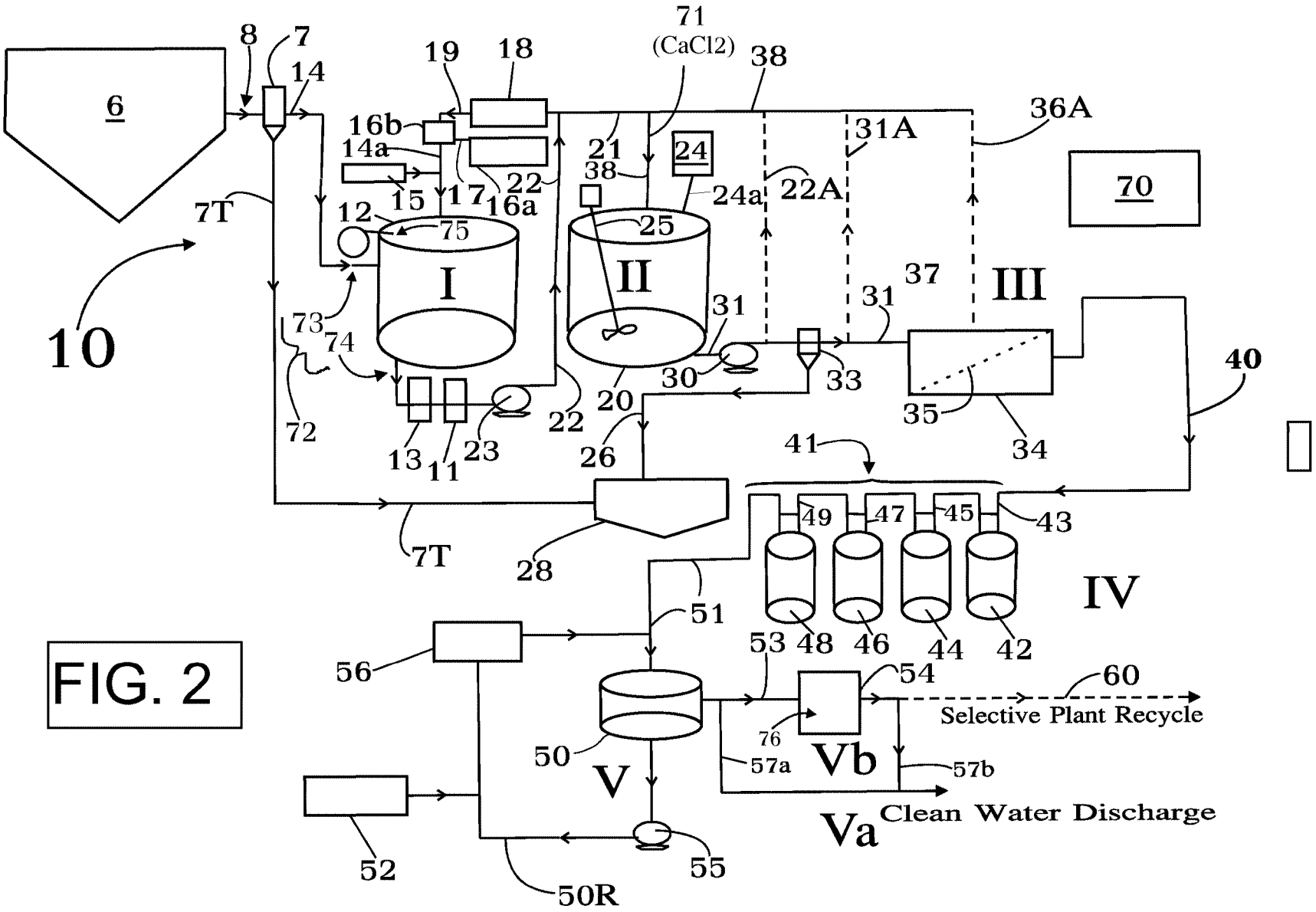
FIG. 2 illustrates another earlier filed co-pending embodiment of the Concentrate Treatment System method of the present invention.
Figure 3:
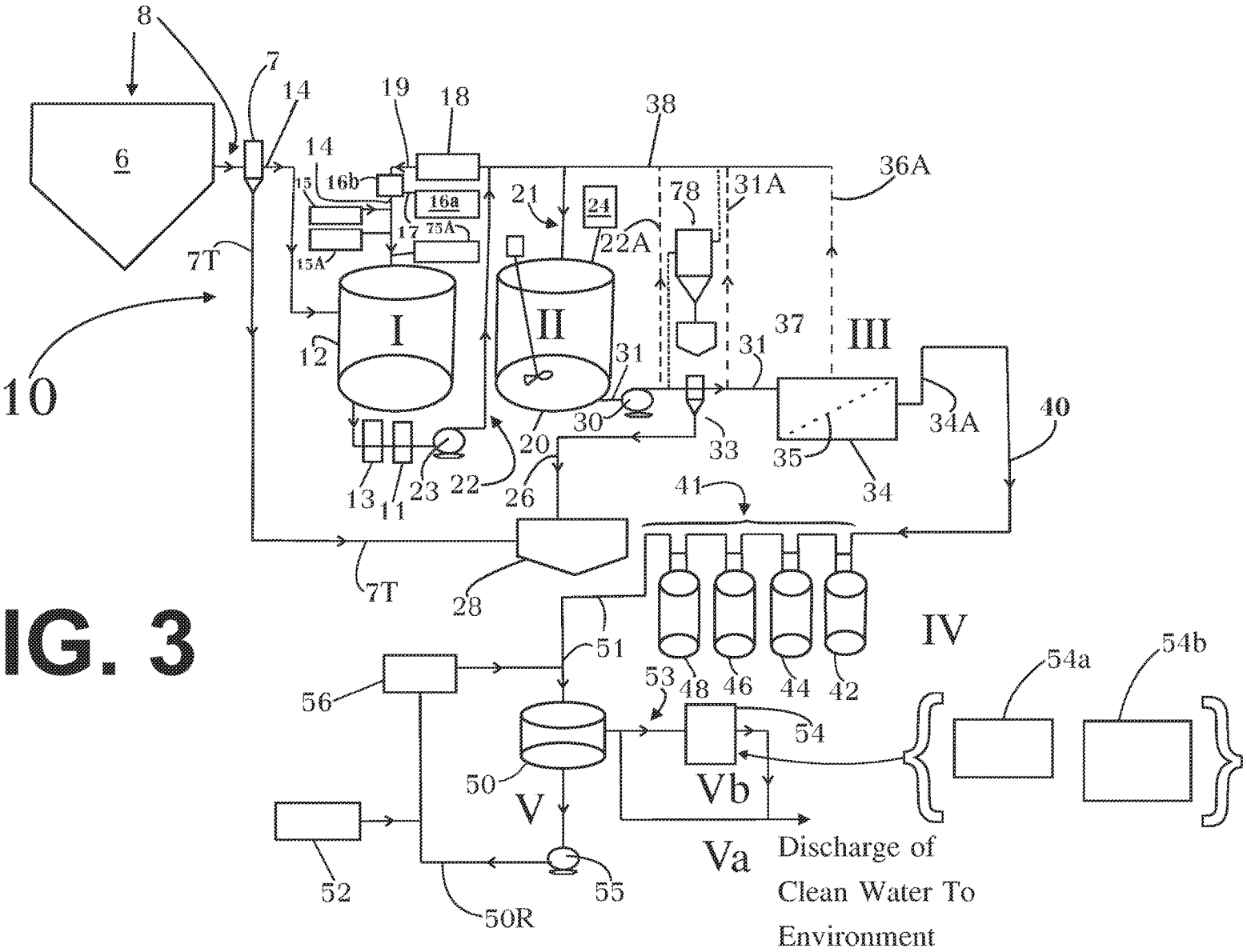
FIG. 3 illustrates a present preferred embodiment of the invention in this continuation-in-part application.

The reader is directed to FIGS. 2 and 3, herein. The present invention has resolved problem of oxidation of the chelants to release the isotopes for removal. Testing of the invention indicated that complete destruction of the chelants were required before the complete release of cobalt, cesium, antimony and other isotopes. The oxidation of the chelants occurred at a mV reading of approximately +500 mV. Oxidation using ozone was able to reach this oxidation state but only at decreased temperature ranges of <30° C. The heat generated both in the oxidation and the recycle pumping raised the temperature of the concentrate to above 40° C. At higher temperatures, the decomposition of the ozone competed with the oxidation process as the solubility of the ozone in water approached zero. This showed that some temperature control would be required to maintain temperatures below 30° C. and preferably below 20° C.

Other testing of the embodiments of the invention determined that sorbent must be added after the oxidation process and in a separate vessel as ozone attacked the residual sorbent causing the release of the isotopes and formation of complex isotopes that were not easily removed from solution.

The testing of sorbents was done exclusively outside the oxidation system to prevent residue remaining in the oxidation vessel. This led to the realization that two processing vessels, in embodiments would be required to optimize production and prevent any interference from oxidized sorbent.

In testing, foaming was an issue for at least some of the concentrates but could be controlled using anti-foaming agents or controlled oxidation during the first 10-20 minutes when foaming agents appeared to be destroyed by ozone. Testing of an anti-foaming agent on the mixed concentrate determined it was effective. Although not completely eliminating foaming it minimized it to approximately 10 cm of foam. The foam completely disappeared during the first half hour of oxidation in most cases. This also coincided with the oxidation time required to reach +100 mV oxidation potential.

The powdered sorbents were found to be quite effective at removing a large percentage of both cesium and antimony isotopes. Optimization and quantification of the removal media was completed with determination of the approximate quantities of the sorbent required based on the initial concentration of the cesium and antimony radioisotopes. A general range of 0.5-1 percent by weight of the cesium powdered sorbent was required for 99% removal.

The concentrate pH is a large factor in the capacity and decontamination factor (DF) of the media. The capacity and DF of media decrease as the pH increases above a pH of 11. In later testing of EMO concentrates the pH was adjusted below 12 for testing. Indications are that a pH of <11 is much more effective and requires much less sorbent.

The removal of cesium and antimony using sorbents is important since the powdered sorbents generate far less waste than the selective ion exchange media. The powdered sorbents do not easily release activity once the radioisotopes are chemically bonded. The selective IX media do have some capability to release some isotopes in preference to isotopes that they are primarily designed. An example of this is the uptake of $Ag^{110m}$ and $Se^{75}$ by antimony selective media and later release due either to increased pH or reaching near capacity with antimony. Cesium media seems less susceptible to release of other isotopes as it seems even more ion specific.

With regard to Ozone and the Oxidation Step in the present invention and system it is crucial in destroying the chelants and all other organics present. All organics must now be converted to carbon dioxide to be assured that all the C-14 can be removed. Ozone is a powerful oxidant that can attack and destroy all the chelants and fouling agents. However, as indicated in part below, other similar acting oxidation agents can be used. The oxidation products are mainly carbon dioxide and water.

In preferred embodiments the concentrate feed to the present system is first pretreated, when necessary, with anti-foaming agent to prevent foam from exiting the oxidation vessel in the gas stream. Ozone then destroys all of the organics and oxidizes any of the isotopic metal corrosion products. The organics of most concern are the chelants present from decontamination operations. The very high oxidation potential of the ozone is able to attack and destroy these chelants during pretreatment. The destruction of the chelants releases the radioisotopes so that they either precipitate or can be ion exchanged. With regard to C-14 (or $^{14}C$) all the organics must be destroyed to form or produce carbon dioxide to assure removal of the C-14.

In one embodiment, ozone is produced from dry compressed air that is separated by pressure swing absorption (PSA) into about 93% pure oxygen. Ozone is introduced into the Recycle Pressure Vessel through the recirculation system by an educator and further mixed to assure high utilization. The oxidation process continues until all the chelants are destroyed as indicated by a much higher ORP reading usually in the range of +700 to +1000 mV. In this ORP range the final completion of destruction of the organics is signaled by a further decrease in the pH caused by resumed generation of excess CO2 from the broken carbon chains of the oxalic, citric and EDTA chelants. Since the organic pieces from the broken chelants do not retain cobalt and other isotopes the complete destruction of these organics is not required but due to the need to remove essentially all the $^{14}C$ all organics must now be destroyed since one does not know which organics contain the $^{14}C$.

Although ozone is the supplied oxidant to the system, manganese may act as a catalyst with manganese dioxide being oxidized to permanganate which in turn oxidizes the chelants and returns to manganese dioxide. This appears to be the case as oxidation occurs at an ORP level where the presence of small quantities of permanganate should be present. Since manganese is present in the concentrate, no additional manganese must be added. This presence of manganese is also the controlling factor for the ORP level at completion of the chelant oxidation. A significant amount of ozone is required to completely oxidize all the permanganate after which residual ozone in solution could be detected leading to a much higher ORP value that has been seen in other applications.

Although we discuss citric and oxalic acid as being the chelating agents these have been converted to either potassium or sodium citrate and oxalate when the pH was adjusted to a pH of 11.5-13.7 with potassium or sodium hydroxide. During oxidation of these chelants with ozone/permanganate a combination of carbon dioxide, potassium/sodium hydroxide and water are generated. The carbon dioxide at high pH is immediately converted to carbonate. This conversion process is the reason for decreasing pH during the oxidation process when hydroxide is also not being generated in equal molar ratios.

The relative ease of oxidation has the following order: carboxylic acid>oxalic acid>acetone dicarbonic acid>citric acid. This means that the oxalic acid will be oxidized first followed by the citric acid.

Oxidation of some of the longer chains into shorter chains can be seen in looking at the ORP testing where the pH remains constant and the ORP slowly rises. Later the pH will begin to drop signaling the production of $H_2CO_3$ from the methyl ($CH_3$) groups.

Powdered sorbents have shown to be an effective way to remove 99-99.9% of the cesium and 60-99% antimony activity prior to the selective ion exchange columns. This provides a method of assuring higher overall DF's since DF's in the range of $10^4$ to $10^5$ will be required to meet the <100 Bq/kg total discharge requirement for the dry solids. This summation includes the fractional part of all isotopes limits.

Testing of the present invention showed oxidative destruction of all the chelants is required for compete removal of the Class 1 isotopes. Since the $^{14}C$ moved to the Class 2 isotopes the remaining organics had to also be oxidized to meet the <1000 Bq/kg limitation for $^{14}C$ and other Class 2 isotopes. The testing also showed that powdered sorbents are easily oxidized by the ozone, thus showing that sorbents should be added in a separate step after oxidation is complete.

Filtration is the step or sub-method for rejecting all the remaining particulate which includes both isotopic and non-isotopic solids. Many of the isotopes, such as Cobalt, Manganese, Chromium, Iron, Silver and others are often found primarily as oxide and carbonate solids, thus they are preferably removed as particulate.

The preferred media used for polishing applications in preferred embodiments of the invention include such examples, without limitation of:

Exemplar Ion Selective Media

Cesium Selective DT-30/30D

Antimony Selective DT-47/47D

Cobalt/Manganese Selective DT-48C

In testing of preferred embodiments of the invention it was indicated, after reaching the <5 Bq/L results from the selective ion exchange columns, that a small quantity was dried in both a normal oven where it was dried to dry solids and then placed in a kiln for approximately 24 hours to drive off the water of hydration of the waste.

C-14 ($^{14}C$) testing was conducted using both oxidation samples from the two selected sources. Testing was done using the vacuum removal that would be employed just after the oxidation is completed. This is done after the pH is lowered to <4 to convert all the carbonate present to carbon dioxide which has very low solubility at this low pH. A vacuum is then applied to the OS recycle vessel and the concentrate pump through a degassing membrane where only gases were transmitted to increase the surface area. A high vacuum was also applied to the membranes and a small sweep volume of air is used to remove carbon dioxide from the gas side of the membranes, thus improve equilibrium results.

The results in these tests resulted in undetectable carbon-14 (C-14), <5.5 Bq/L, which represented less than 0.5% of the regulatory limit applied as a standard during the testing at that time.

Within the oxidation step in testing, Ozone oxidation was characteristically continued until oxidation approached +700 mV or higher to assure complete oxidation of all organics to carbon dioxide.

The temperature during recirculation of the concentrate in the system during the oxidation, in testing of preferred embodiments was controlled to a good extent using the mini chiller during this round of testing. The maximum temperature that was reached during oxidation was 27° C. but in most cases the temperature stayed below 23-26° C. This permitted continuous operation over many hours where, without the chiller, the temperature often would reach 40° C. in 4-6 hours after the start of oxidation. The lower temperature increased the solubility of ozone in the concentrate, thus permitting more efficient utilization of ozone for oxidation versus decomposition and loss to the ventilation system.

Regarding $^{14}C$ removal, under selected Guidelines the amount of $^{14}C$ that could be remaining in the concentrate solids was reduced by a factor of three, thus making what had been a matter previously of little or no concern, to a matter of major concern as the previous equipment had no method for removal of $^{14}C$ from the solids. Since the $^{14}C$ was already converted to $CO^2$ during the oxidation process in the invention to destroy the chelants this only had to be expanded to assure that all carbons were destroyed from organic form to carbon dioxide. Thus, this is accomplished by increasing the endpoint of oxidation from approximately +500 mV to about +700 mV.

The carbon dioxide is then totally removed from solution by adjusting the pH to <4 using nitric acid. At a pH of <4 the solubility of the carbon dioxide is nearly zero causing the carbon dioxide to leave just as it leaves a soda. This is further assisted by applying a vacuum and membranes to increase the surface area. Testing indicated repeatedly that non-detectable levels of $^{14}C$ could be achieved. This provides a DF of up to 2100 for $^{14}C$ removal, but in all cases to undetectable levels.

After the carbon dioxide is removed the pH is readjusted to a pH of approximately 10.7 to increase the solubility of boron during the sorbent treatment and selective ion exchange steps. At this point any undissolved borate is re-dissolved so that it is not removed during the solids separation stage in the following processing. If necessary a small amount of DI water can also be added or the pH can be raised to a higher level. Any additional water added will have to be removed during the drying steps.

In other testing of the invention, the pH was adjusted to 10.78 using 40 ml nitric acid, as the effectiveness of the sorbents and selective ion exchange media is greater at lower pH. Five (5) L of concentrate was removed to begin sorbent testing. Oxidation was continued on the remaining 3.5 L after about 2.3 hours during which the eductor check valve was cleared. The starting ORP was +585 and within 10 minutes the ORP increased to +750 mV indicating the oxidation was substantially complete. At these high ORPs the Mn+4 was converted to Mn+7. Since the Mn+7 (permanganate) is also a very strong oxidant, the chances any organic material remained in this testing was quite small; thus indicating, all the $^{14}C$ had been converted to carbonate.

In another preferred embodiment of the present CTS invention method and system 10, this system consists of the following sub-systems or steps: Ozone Oxidation System, Chiller, Sorbent Isotope Removal, Tubular Ultra Filter (such as UltraFilter or TUF™) and Selective Ion Exchange, Drum Dryer (such as for example, DrumDryer™ System) and Drum Kiln application.

In this regard the Ozone and Oxidation Pretreatment System or retreatment system is crucial in destroying the chelants present and protecting the membrane systems from fouling. Ozone is a powerful oxidant that can attack and destroy the chelants and fouling agents. The oxidation products are mainly carbon dioxide and water.

The radwaste water feed to the present system (10) is pretreated, as necessary, with anti-foaming agent and then with ozone, to destroy all of the organics and oxidize any of the isotopic corrosion products causing precipitation. The organics of most concern are the chelants present from decontamination operations and any organics containing $^{14}C$. The very high oxidation potential of the ozone is able to attack and destroy these chelants and any other organics during pretreatment. The destruction of the chelants releases the radioisotopes so that they either precipitate or can be ion exchanged. Destruction of all the organics releases the C-14 to carbon dioxide which at the high pH is converted immediately to carbonate.

The ozone, in preferred embodiments is produced from dry compressed air that is separated by pressure swing absorption (PSA) into about 93% pure oxygen. Ozone is introduced into the Recycle Pressure Vessel through the recirculation system by an educator and further mixed to assure high utilization. The oxidation process continues until all the chelants are destroyed as indicated by a much higher ORP reading, usually in the range of +700 to +1000 mV. In this ORP range the final completion of destruction of the chelants is signaled by a further decrease in the pH caused by resumed generation of excess $CO_2$ from the broken carbon chains of the oxalic, citric and EDTA chelants.

As indicated, at least in part herein, although ozone is the supplied and preferred oxidant to the system (10), manganese may act as a catalyst with manganese dioxide (Mn+4) being oxidized to permanganate (Mn+7) which in turn oxidizes the chelants and returns to manganese dioxide. This is the case in the present invention, as oxidation occurs at an ORP level where the presence of small quantities of permanganate should be present. Since manganese is present in the concentrate, no additional manganese must be added. This presence of manganese is also the controlling factor for the ORP level at completion of the chelant oxidation. A significant amount of ozone is required to completely oxidize all the permanganate after which residual ozone in solution can be detected leading to a much higher ORP value that has been seen in other testing applications of the invention.

The testing showed that temperatures of the concentrate increased due to oxidation exothermic reactions and mechanical heat input from pumping and recirculation. This temperature increase needs to be minimized to prevent both excess decomposition of the ozone and loss of ozone solubility prior to complete oxidation of the chelants, thus releasing the chelated isotopes and oxidation of the cobalt resulting in its precipitation and filtration removal. A heat exchanger with a chiller will provide temperature reduction and control in the 15-30° C. range.

The pH is also an important factor in ozone oxidation with lower pH values producing faster oxidation and utilization of the ozone. At pH >12.5 the oxidation of chelants is very difficult with the decomposition of ozone being the dominant reaction. By lowering the pH to 10.7 the reaction time decreased to at least half and possibly less than one quarter of the time as shown by the EMO adjusted to pH 11.4 as compared to test setting at pH 13.3 during the start of chelant oxidation. A pH injection system will adjust the feed concentrate to a pH of <12 when necessary and increase pH when pH is decreased too low from carbon dioxide production to assure solubility of boron.

Powdered sorbents in the present invention 10 have shown to be an effective way to remove 99-99.9% of the cesium and 60-99% antimony activity prior to the selective ion exchange columns. This provides a method of assuring higher overall DF's since DF's in the range of 104 to 105 would be required, for example, to meet a <100 Bq/kg discharge requirement for the dry solids.

Initial testing showed that oxidative destruction of all the chelants was required for compete removal of the Class 1 isotopes. The testing also showed that powdered sorbents were easily oxidized by the ozone. Thus, sorbents should be added in a separate step after oxidation is complete. The oxidation of the sorbents both released the isotopes and appeared to prevent the subsequent removal of some isotopes through the use of these sorbents. This resulted in the addition of a sorbent treatment tank which is also used as the TUF™ feed tank. This tank provides for mixing of the sorbent(s) for several hours before filtration and removal.

The sorbent recycle tank has several recirculation paths depending upon the desired stage of operation. A simple recirculation loop that bypasses both the hydro-cyclone and TUF™ was incorporated. This provides for complete utilization of the sorbent media that fall into the outlet at the bottom of the conical tank. The mixer in the tank may not completely suspend all media that may fall and get trapped in the outlet pipe so periodic recirculation are required.

The second recirculation path provides for solids removal from the tank contents using a hydro-cyclone (hydrocyclone). This can be utilized before addition of the sorbents to remove any solids that were initially in the concentrate. This was seen in some testing as a possible problem during beaker stir tests where it appeared that cesium was dissolved from the solids. Since this will only increase the quantity of cesium sorbent required it is best to remove these solids prior to treatment with antimony sorbent. It was also noted that some interference between cesium and antimony sorbents may occur when they are combined in the same mixture. This can be minimized by doing a sequential sorbent processing where antimony sorbent is first used to treat the concentrate followed by removal of this sorbent using the hydro-cyclone followed by addition of the second selected sorbent.

The third recirculation path is used to collect the second use of DT-31E or similar sorbent that will then be reused in the next batch processing thus reducing the consumption and disposal volume for this sorbent. It was found that essentially no overall capacity was lost when this media was reused in the following batch as the amount of cesium and antimony removed was more of a polishing nature.

The first recirculation pathway is then reused through both the hydro-cyclone and the TUF™ (and like equipment discussed herein) to removal solid for further processing by the selective ion exchange. The TUF™ permeate stream represents only 15-25% of the feed stream so the remaining 75-85% of the water is returned to the Sorbent Treatment Tank for return to another pass. This continues until the Sorbent Treatment Tank reaches low level. The remaining concentrate is added to the next batch transferred from the Ozone Recirculation Vessel.

With respect to membrane and vessel degassing, the 14C that must be removed from the system is removed as carbon dioxide after being oxidized by the ozone from its original organic form. The carbon dioxide is removed by first converting the carbonate that was formed at high pH by adjusting the pH to less than about 4. At low pH the carbon dioxide is almost totally insoluble. The solubility is further decreased by using vacuum to further swing the solubility level. The gross amount of carbon dioxide is removed from the recycle vessel by applying a vacuum using a vacuum pump.

The concentrate is then pumped through a degassing membrane that brings the concentrate in very close proximity to the membrane where a very high vacuum is applied. This then brings the concentrate to near equilibrium in a very short period of time. The equilibrium is further lowered by sweeping the carbon dioxide from the membrane surface using air. This process is continued for a set period that has been determined by testing, or selected, to remove the required $^{14}C$.

Ozone and oxygen are also removed in the same process so that carryover of ozone to the sorbent process is nonexistent. The heating of the solution caused by the chemical and steam injection also decreases the solubility of the carbon dioxide and ozone.

With regard to examples of preferred types of media used for polishing applications in the present invention (10), the following are presented as examples, without limitations, which can be utilized, including:

Ion Selective Media
Cesium Selective DT-30
Cesium Selective DT-30D
Antimony Selective DT-47
Antimony Selective DT-47D
Selenium/Zirconium DT-48C Regarding the Drum Dryer, such as the DrumDryer™ (given as an example, without limitation, herein) this equipment is utilized to evaporate all of the free water associated with the concentrate that accounts for approximately 89% of the weight. The water is evaporated using heating elements located in a clamshell around the drum and a heating plate that the drum sits upon. The drum is maintained at approximately −70 kPa which permits the water to boil at <70° C. this improves the heating efficiency and also prevents any escape of vapor from the drum. This water is condensed as essentially deionized water that is returned to the plant through the drain system.

With respect to the Drum Kiln, and its use in preferred embodiments of the present method and system (10), the sealed drums are placed on metal pallets to await heating to remove remaining water of hydration. The pallet containing four drums, for example, with the lids removed is placed in the kiln. The kiln is heated to near about 450° C. This permits the drums to reach a temperature of about greater than (>) 200° C., thus permitting the water of hydration, or remaining amounts thereof, to be released. Testing of the embodiment showed that less than detectable levels of water of hydration could be achieved when heated to 400° C.

The loss of weight experienced during testing was approximately 15% after the free water was removed. This is the water, applying the teachings of the invention that would be expected to be removed in the drum kiln at the elevated temperatures. This water vapor is sent to the plant exhaust system for HEPA filtration before being exhausted to atmosphere. A blower on the kiln provides a slight negative pressure on the kiln and permits dilution with plant air prior to injection into the ventilation system.

The heating process is characteristically slow, thus it is expected that 1-3 days may be required for the drum internals to reach the required >200° C. The release of water is slow; thus there is no concern for water vapor entering the exhaust system, as the normal dilution with air will prevent any condensation.

Thus, with regard to one preferred embodiment embracing teachings discussed above, and example, without limitation, of equipment, or equipment as embraced in steps or sub-steps, to carry out the method and system (10) would include:

Tubular Ultrafiltration System
Ozonator/Oxygen Separation/Eductor
Ozone Mixing System
Recirculation/oxidation Tank
Membrane Degasifier
Vacuum Pump
Sorbent Mix Tank
Selective IX Vessels
Sorbent Feeding System
Hydrocyclone Particulate Remove System
Monitor Tanks
Chiller
DrumDryer™ Evaporation System
Pumps
Instrumentation/Controls, and
Internal and Inter-Skid Piping Additional embodiments address $^{14}C$ and Water of Hydration Removal from waste treated with the present method and system (10). In the ozone step or sub-system removal of $^{14}C$ from the concentrate is accomplished by first making sure all the organics are converted to carbon dioxide/bicarbonate/carbonate depending upon the pH. The concentrate is then adjusted to a pH of <4 to form $CO_2$. At this pH range the solubility of $CO_2$ in water is very low. $CO_2$ is then removed by reducing the partial pressure of $CO_2$ in the air above the concentrate. This is done by a combination of methods including: 1) applying a vacuum, thus decreasing the $CO_2$ concentration above the concentrate, forcing the $CO_2$ to move to the air phase, 2) sweeping the air from the surface of the concentrate (water), thus reducing the concentration of $CO_2$ at the surface, 3) pressurizing the concentrate and passing it through gas permeable membranes where the pressure on the other side of the membranes is much lower (preferably a vacuum).

In this present embodiment, the original system is changed from using an atmospheric tank to a pressure tank in this embodiment so that a vacuum can be applied to the tank. The system used for applying ozone can also be used to dissolve either air or oxygen, thus creating a purging of the solution with nitrogen/oxygen or just oxygen, and thus decreasing $CO_2$ partial pressures. Air can alternately be sparged into the bottom of the ozone recirculation tank to generate a similar affect. The addition of a membrane gas separator is also added in this embodiment to remove $CO_2$.

With regard to TUF, given as an example of such equipment utilized in the invention, discussed above, another approach in the present method (10) is to lower the $^{14}C$ level by adding a precipitant when the pH is elevated in the Sorbent tank. Metals such as Ca and Ba have low solubilities which will lower the $^{14}C$ in solution. This can then be filtered using the ultrafiltration membranes.*

With regard to IX utilization in the present method (10), an Anion form ion exchange resin can remove $^{14}C$ as the $CO_3$ since borate is much less strongly held. The disadvantage of this approach in the present method is it generate more solid waste as compared to exhausting the $^{14}C$ to atmosphere.

Regarding the use of Drum Dryer (such as, for example a DrumDryer™) equipment as discussed above, if the DrumDryer is used to remove the $^{14}C$ and water of hydration the pH of the DrumDryer feed must be adjusted to a pH of equal to or less than (<) 4 to assure that all the inorganic carbon is converted to $CO_2$. If, in utilizing this invention embodiment, only water of hydration is to be removed the pH of <5 is required to assure all the boron is in the boric acid form. The Drum Dryer equipment uses a combination of heat and vacuum to remove either or both. The low pH will require the use of either stainless steel drums or mild steel drums with a phenolic or similar heat resistant coating or equivalent types of equipment.

If only water of hydration is to be removed, the DrumDryer can provide enough temperature for the concentrate can reach >200° C. but the time required may be several days because the delta temperature is <50° C. and the transfer must be all the way to the center of the drum with heat being consumed to break the chemical bonds. What has not been determined is whether vacuum lowers the bond breaking temperature but it is doubtful.

Regarding the use of the Drum Kiln or such equivalent equipment, if the pH of the concentrate is maintained at a high value, the temperature of the sodium borate must be raised to >200° C. under ambient conditions. The Drum Kiln has much higher temperature differentials of >200° C.; thus it is preferred for use in this embodiment for these purposes.*

Figure 4:
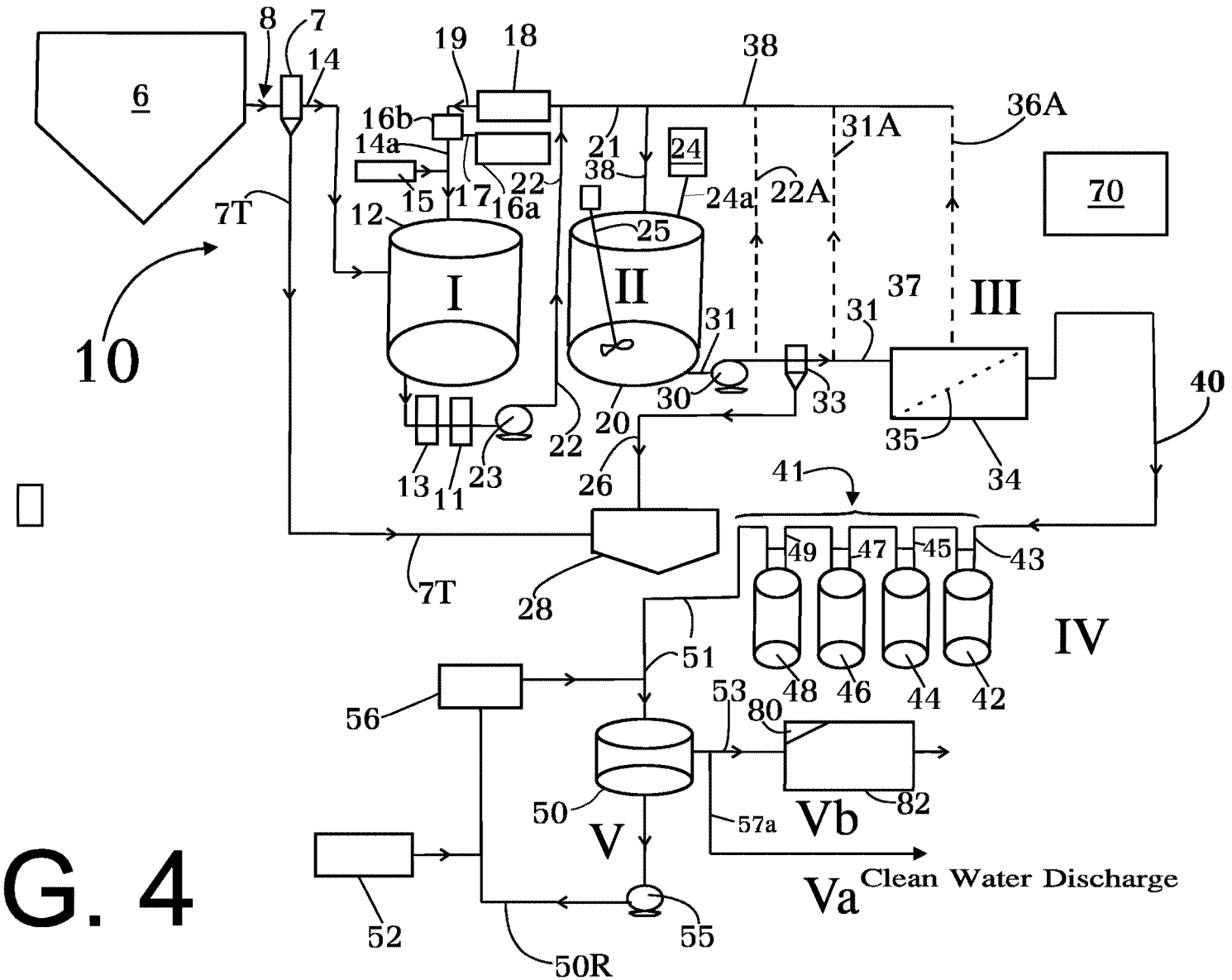
FIGS. 4 through 7 (4-7) illustrate preferred embodiments of the present method and invention in this application where thin film evaporator means (80) and mixing dryer means (82) are utilized in drying.
Figure 5:
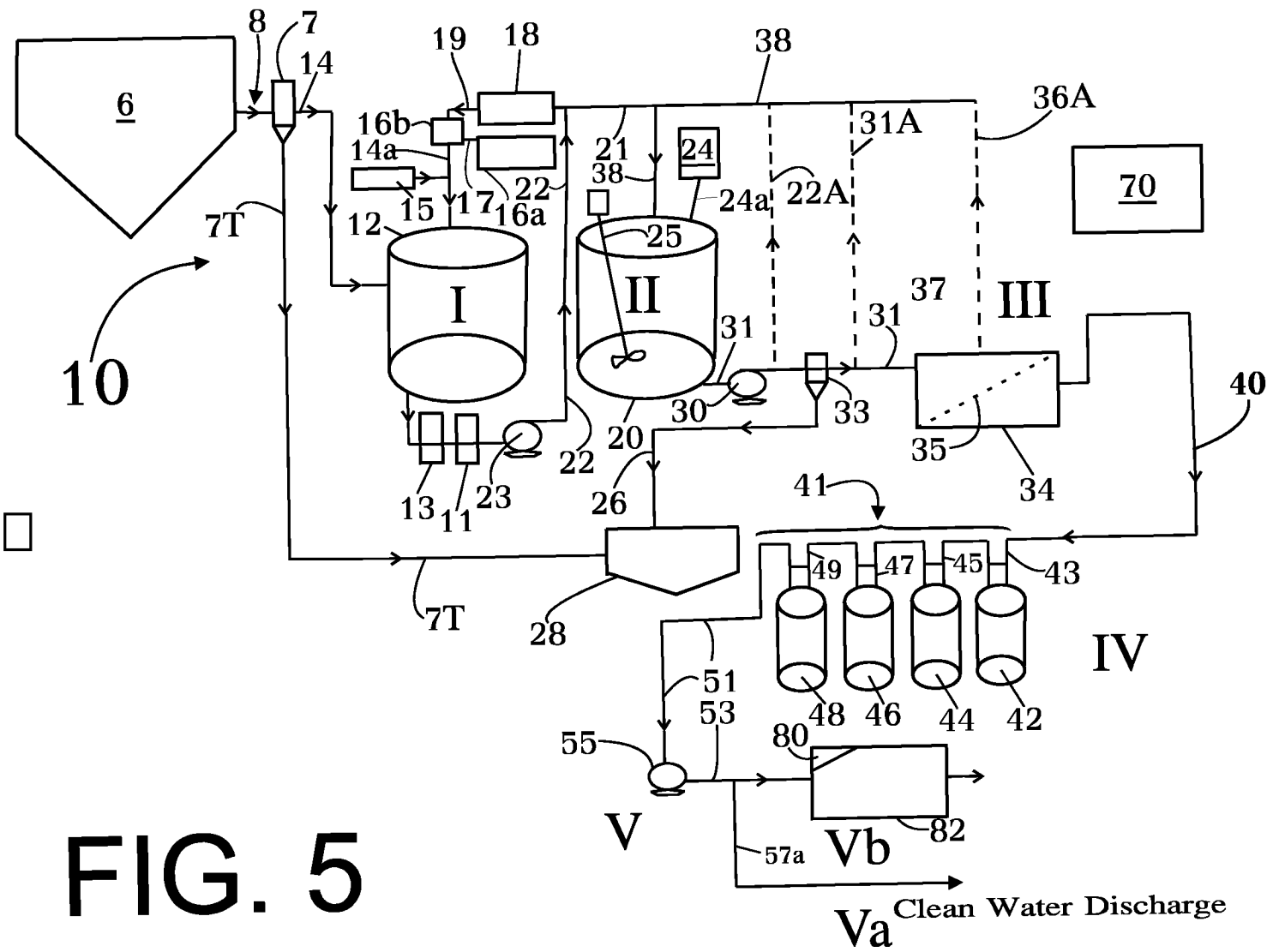
Figure 6:
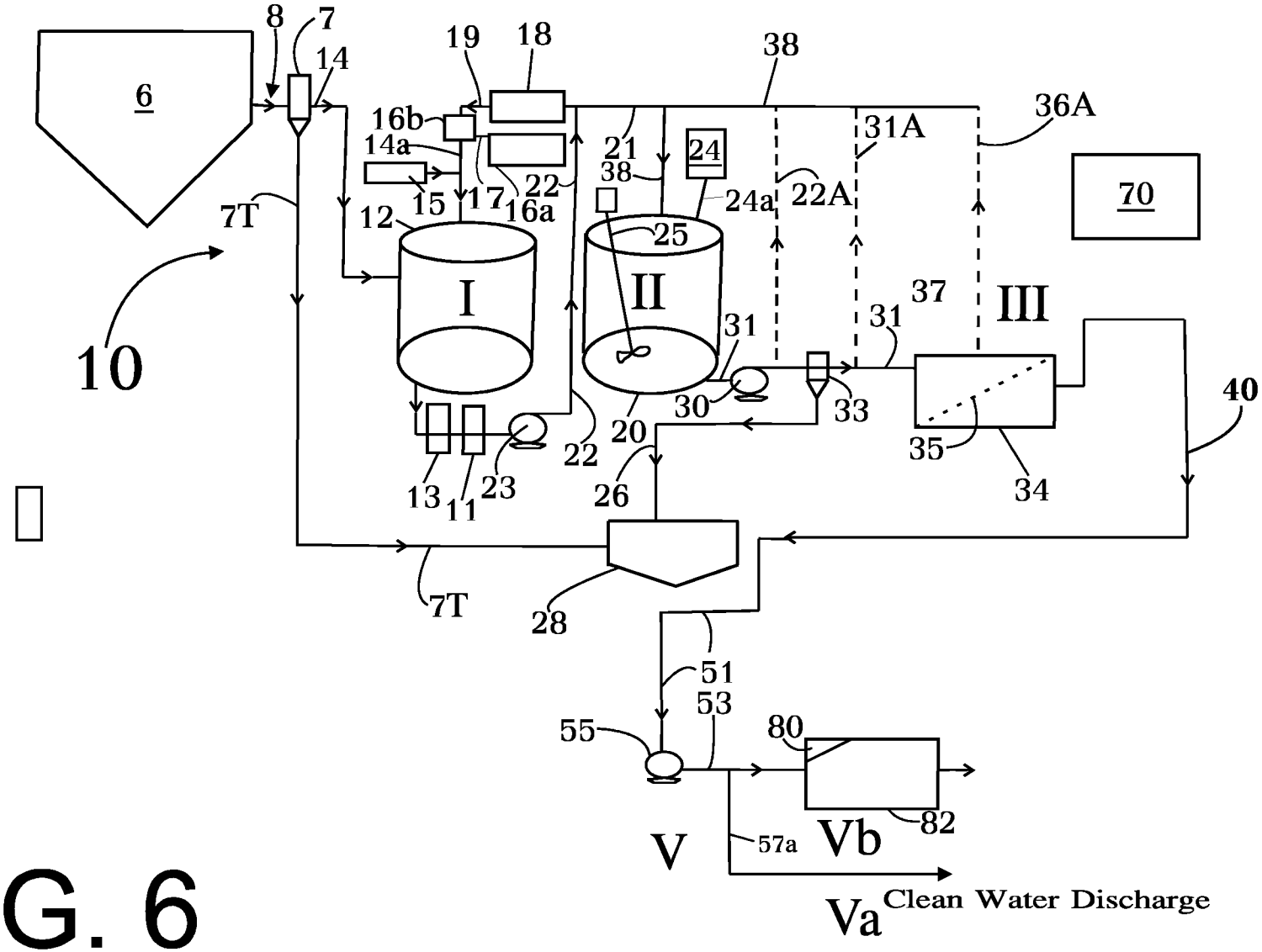
Figure 7:
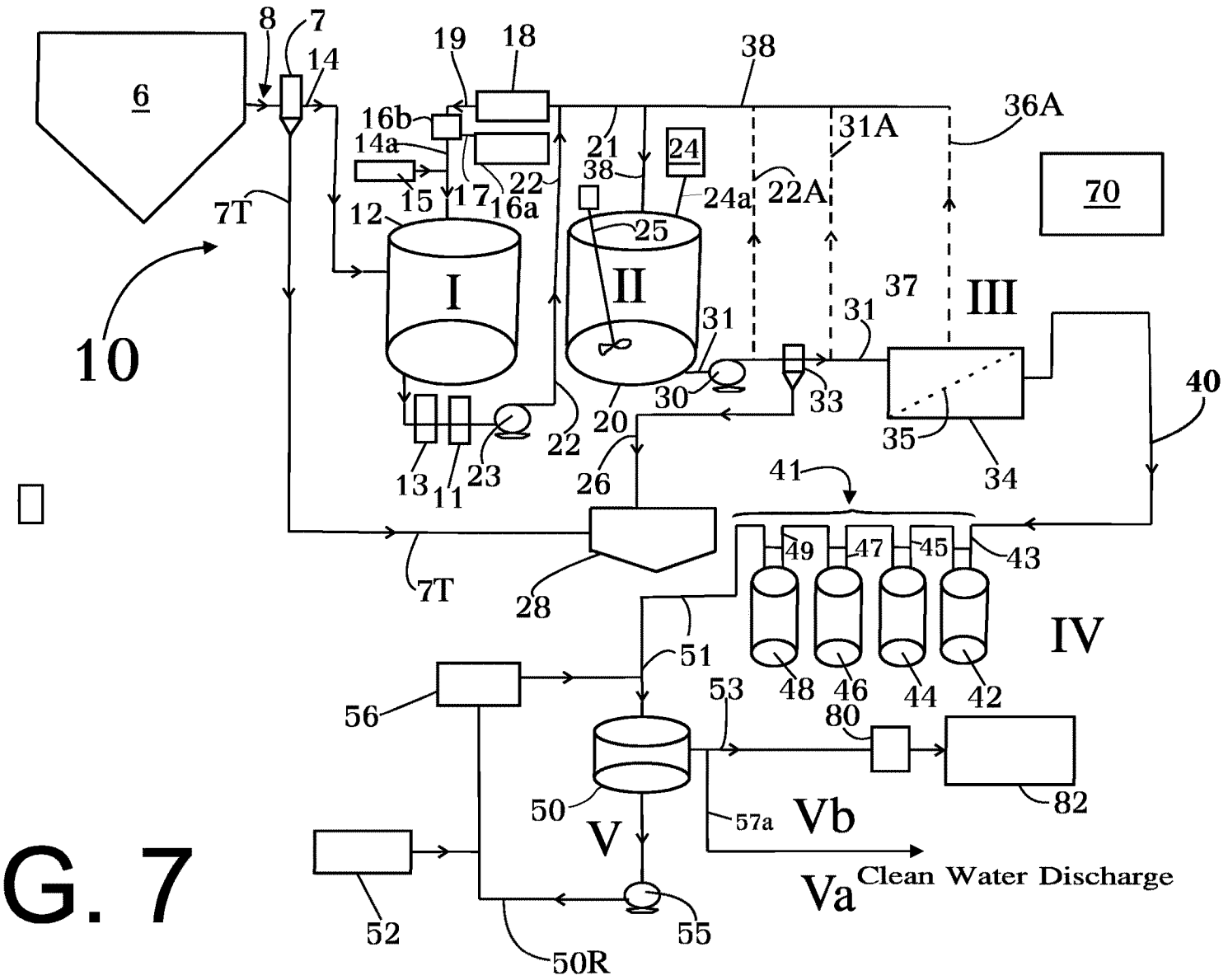

A further embodiment of the present invention and method (10) utilizes the effects and use; and sub-system and step; of the Thin Film Evaporator (TFE) (80) and Mixing Dryer (82). This further embodiment replaces the Drum Dryer equipment and Drum Kiln, illustrated in FIG. 3, and requires a different pH regime. The dryer (82) utilized as preferred equipment in this embodiment is a Readco SC proceed by a TFE (80), but various other equipment such as rotary screw dryers, paddle and ribbon dryers, among other examples, can also be used to form or produce a granular, pellet or powder waste formation or product. The TFE (80) and Mixing Dryer (82) are typically connected directly, as illustrated in FIGS. 4, 5 and 6, as both operate under vacuum and the precipitate formed by the TFE simply falls into the Mixing Dryer. However, such units can be utilized in relation to one another though spaced from one another, as illustrated by diagrammatic example in FIG. 7; and the depiction of the TFE (80) and the Mixing Dryer (82).

In the case where granular or powder product is preferred over a monolith, the Mixer Dryer (82) becomes a more appropriate choice within the scope of the invention. The Mixer Dryer (82) also provides more flexibility with regards to pH as this equipment does not have the same restrictions with regard to materials as the DrumDryer. The Mixer Dryer (82) also has the ability to remove both the carbon dioxide and the water of hydration in a single process step. In the previously described embodiments these were removed in two different steps of the process. The new embodiment can decrease the amount of chemicals required and decrease the energy requirements of the process by lower evaporation temperatures.

This equipment (80) and (82) can be used over a wide range of pH depending upon the goals of the drying and the hazardous and radioactive isotopes present. In the case where $^{14}C$ or $CO_2$ must be removed the pH must be lowered to a pH of approximately or about 4 to remove essentially all the carbon dioxide as a gas in the dryer.

In order to remove water of hydration from the boron containing compounds must be lowered to a pH of approximately about 5 to assure that all the boron is converted to boric acid that has no water of hydration. Otherwise, at higher pH the temperature of the dried material must be raised to a temperature of greater than (>) about 200 C to remove all water of hydration that forms in sodium borate forms of the boron. The dryer is preferably operated under vacuum to lower the boiling point of water and aid in carbon dioxide removal, but is not required and could be operated under ambient conditions and with an air or gas flush.

This method produces a granular product rather than a monolith block when the product is to be used as a recycle product or needs to be mixed with a solidification agent for further treatment. This product, or formed matter, can be discharged into most any type of container.

The pH adjustment should be done prior to the mixer dryer stage to assure that proper pH range is achieved prior to the drying process.

This process or sub-process, then, does not require the removal of $^{14}C$ or $CO_2$ earlier in the process, although the pH should be lowered to approximately or about 4 to assure complete removal of $CO_2$. The mixer dryer equipment utilized herein has the advantage of lower energy and chemical requirements to reach the endpoint because the amount of variation from high to low pH and back to high pH is reduced only lower the pH. The system, in utilizing the equipment in the manner set out, is also smaller in size than the previously discussed drum dryers or drum drying equipment.

The gaseous effluent of the mixer dryer can be sent to a ventilation system to remove both water and carbon dioxide. If water needs to be removed a condenser can be used to condense the water but permit the carbon dioxide to pass to the environment. The $CO_2$ could also be captured using a scrubber using caustic, and other such types of equipment; though, in this embodiment the condenser is preferred but not required.*

While the preferred embodiment of the invention has been illustrated and described, it will be appreciated that various changes can be made therein without departing from the spirit and scope of the invention.

We claim:

1. A system for treating a liquid or an aqueous wastestream comprising $^{14}C$ and for converting the liquid or the aqueous wastestream into a first form which can be evaporated to a solid, or a solidified form, and a second form which is aqueous and which can be safely discharged to the environment, the system comprising a thin film evaporator (TFE) and a mixing dryer for:

oxidizing the liquid or aqueous wastestream such that a chelant, an organic material, or a substance contained in the wastestream is substantially rendered non-effective or destroyed and the wastestream is rendered subject to, or permissive of, precipitation of cobalt and other metals as dissolved solids and release of other isotopes or removal or ion exchange;

mixing the oxidized liquid or aqueous wastestream with at least one target sorbent material for isotopic reduction;

separating undissolved solids from the liquid or aqueous wastestream having dissolved solids after mixing;

treating the liquid or aqueous wastestream by Selective Ion exchange (IX), and final processing selected from the group consisting of discharging the treated liquid or aqueous wastestream, drying the treated liquid or aqueous wastestream having dissolved solids to dry solids, as the solidified form, and a combination thereof, wherein drying further comprises feeding or communicating the treated liquid or aqueous wastestream into the thin film evaporator or TFE and the mixing dryer to form a granular, pellet or powder waste formation or product and, wherein, pH in the mixing dryer is at about 4 to about 7 prior to the treated liquid or aqueous wastestream entering the mixing dryer.

2. The system of claim 1, wherein, drying further comprises feeding or communicating the liquid or aqueous wastestream into a thin film evaporator or TFE and a mixing dryer to form a granular, pellet or powder waste formation or product; and, wherein pH in the mixing dryer is at about 5 prior to the liquid or aqueous wastestream entering the dryer.

3. The system of claim 1, wherein, oxidizing is by ozone oxidation further comprising:

communicating the liquid or aqueous wastestream from a facility or storage area through a solids separator, whereat a solids portion of the liquid or aqueous wastestream is conveyed to a solids collection tank, and a remaining portion of the liquid or aqueous wastestream is conveyed to a recycle oxidation vessel for processing therein, and, wherein, prior to entering the recycle oxidation vessel pH is adjusted to a range of about 4 to about 7.

4. The system of claim 1, wherein, oxidizing is by ozone oxidation further comprising:

separating solids from the liquid or aqueous wastestream, adjusting pH of the liquid or aqueous wastestream within a range of about 6 to less than about 12.5, affecting oxidation of the liquid or aqueous wastestream such that cooler temperature-adjusted ozone being utilized to destroy a chelant or other organic found to exist in the liquid or aqueous wastestream, and, wherein, a volume of $CO_2$ containing C-14 and other organics being generated therefrom, adjusting pH in the liquid or aqueous wastestream to a magnitude less than or equal to about 4, for removing the volume of $CO_2$ containing C-14 and other organics, readjusting pH to a range of from about 10 to about 12.5, and evacuating and communicating the liquid or aqueous wastestream through degasification and vacuum.

5. The system of claim 3, wherein Sorbent Isotopic Reduction further comprises:

selecting at least one sorbent substance to remove at least one subject target element or isotope from the liquid or aqueous wastestream transferred to a sorbent treatment area, adding the at least one sorbent substance selected to the sorbent treatment area and mixing it therewithin, and wherein the at least one sorbent substance is selected from a group consisting of a powdered, granular, liquid ionic flocculent; CaCl2; Ca(NO3)2; other soluble calcium salts; other forms of sorbents; and a combination thereof.

6. The system of claim 5, wherein a cesium sorbent is selected and used in the sorbent treatment area.

7. The system of claim 6, wherein a separation and storage area comprises equipment selected from the group consisting of a hydrocyclone, a collection tank, and a combination thereof.

8. The system of claim 5, wherein Solid-Liquid Separation further comprises:

filtering the liquid or aqueous wastestream remaining through a filter media.

9. The system of claim 8, wherein Selective Ion exchange further comprises:

processing the liquid or aqueous wastestream by selective removal of isotopes, wherein the system comprises at least one vessel unit for ion exchange, and wherein one and more such vessels are selectively deployable in series.

10. The system of claim 9, further comprising after discharging or drying:

guiding at least a part of the liquid or aqueous wastestream remaining through a recycling subprocess where the liquid or aqueous wastestream is returned to an area for storing and monitoring fluid.

11. The system of claim 10, wherein:

drying comprises use of equipment selected from the group consisting of an evaporator feed conveyance, an evaporator, a connection from the evaporator for recycle back to a facility or storage area, and a combination thereof.

12. The system of claim 11, wherein recycle comprises:

transferring at least part of the wastestream remaining from the storing and monitoring fluid area to an IX effluent conveyor, and providing for pH adjustment in communication with the IX effluent conveyor.

13. The system of claim 1, wherein in drying the wastestream is brought to a temperature of about 425 degrees C.

14. The system of claim 1, wherein, in drying the pH is adjusted within a range of from about 6 to about 13.

15. The system of claim 1, wherein in drying the wastestream is brought to a temperature of about 300 degrees C.

16. The system of claim 15, wherein in drying the pH is adjusted within a range of from about 6 to about 13.

17. The system of claim 1, wherein in drying the wastestream is brought to a temperature within a range of from about 300 degrees to about 425 degrees C.

18. The system of claim 17, wherein in drying pH is adjusted within a range of from about 6 to about 13.

19. The system of claim 1, wherein in drying the wastestream is brought to a primary temperature of less than about 200 degrees C.

20. The system of claim 19 wherein, in drying the wastestream is brought to a secondary temperature of from about 200 degrees C. to about 470 degrees C.

21. The system of claim 20, wherein in drying the pH is adjusted within a range of from about 6 to about 13.

22. The system of claim 1, wherein equipment is selected from the group consisting of a drum dryer, a kiln, and a combination thereof.

23. The system of claim 22, wherein the drum dryer is utilized to affect or bring about the primary temperature and the kiln is utilized to affect or bring about the secondary temperature.

24. The system of claim 3, further comprising:

an area for measuring a property of the liquid or aqueous wastestream, the property selected from the group consisting of pH, temperature, oxidation-reduction potential (ORP) level, and a combination thereof.

25. The system of claim 24, further comprising:

a treatment for adjusting the property of the liquid or aqueous wastestream, the property selected from the group consisting of pH, temperature, oxidation-reduction potential (ORP) level, and a combination thereof.

* * * * *